US011627410B2

(12) United States Patent
Kim et al.

(10) Patent No.: US 11,627,410 B2
(45) Date of Patent: Apr. 11, 2023

(54) DIRECTIONAL ACOUSTIC SENSOR

(71) Applicant: SAMSUNG ELECTRONICS CO., LTD., Suwon-si (KR)

(72) Inventors: Cheheung Kim, Yongin-si (KR); Sungchan Kang, Hwaseong-si (KR); Hyeokki Hong, Suwon-si (KR); Hyunwook Kang, Hwaseong-si (KR); Yongseop Yoon, Seoul (KR); Choongho Rhee, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/717,920

(22) Filed: Apr. 11, 2022

(65) Prior Publication Data

US 2022/0240005 A1 Jul. 28, 2022

Related U.S. Application Data

(62) Division of application No. 17/003,357, filed on Aug. 26, 2020, now Pat. No. 11,317,197.

(30) Foreign Application Priority Data

Jan. 13, 2020 (KR) ..... 10-2020-0004310

(51) Int. Cl.
*H04R 1/32* (2006.01)
*H04R 3/00* (2006.01)
*H04R 17/10* (2006.01)

(52) U.S. Cl.
CPC ..... *H04R 1/32* (2013.01); *H04R 3/005* (2013.01); *H04R 17/10* (2013.01); *H04R 2201/40* (2013.01)

(58) Field of Classification Search
CPC ..... H04R 1/32; H04R 3/005; H04R 17/10; H04R 2201/40
See application file for complete search history.

(56) References Cited

U.S. PATENT DOCUMENTS 7,903,829 B2 3/2011 Kubota
9,602,930 B2 3/2017 Park
(Continued)

FOREIGN PATENT DOCUMENTS

DE 102016206566 A1 10/2017
DE 102018133329 A1 6/2019
(Continued)

OTHER PUBLICATIONS

English machine translation of KR 101512316 (Jang et al., Directional sound sensor and method for manufacturing the same, published Jan. 2015) (Year: 2015).*
(Continued)

*Primary Examiner* — Mark Fischer
(74) *Attorney, Agent, or Firm* — Sughrue Mion, PLLC

(57) ABSTRACT

A compact directional acoustic sensor having an improved signal-to-noise ratio is disclosed. The disclosed directional acoustic sensor includes a first sensing device configured to generate different output gains based on different input directions of external energy, and configured to generate at least one first output signal having a first polarity based on external energy received from an input direction; a second sensing device configured to generate different output gains based on different input directions of external energy, and configured to generate at least one second output signal having a second polarity, that is different than the first polarity, based on the external energy received from the input direction; and at least one signal processor configured to generate at least one final output signal based on the at
(Continued)

least one first output signal and the at least one second output signal.

10 Claims, 28 Drawing Sheets

(56) References Cited

U.S. PATENT DOCUMENTS

| | | | |
|---|---|---|---|
| 2018/0270587 | A1 | 9/2018 | Lee |
| 2019/0174244 | A1 | 6/2019 | Kim et al. |
| 2019/0200119 | A1 | 6/2019 | Kang et al. |
| 2019/0373362 | A1 | 12/2019 | Ansai |

FOREIGN PATENT DOCUMENTS

| | | | |
|---|---|---|---|
| EP | 2986024 | A1 | 2/2016 |
| EP | 3279622 | A1 | 2/2018 |
| KR | 101512316 | B1 | 4/2015 |
| KR | 1020190067289 | A | 6/2019 |
| WO | 2017087332 | A1 | 5/2017 |

OTHER PUBLICATIONS

Communication dated Mar. 5, 2021 issued by the European Patent Office in application No. 20198330.1.
"Demonstrating the Audio Preprocessing Reference Design for Voice-based Applications on C5517", TI Design: http://www.ti.com/tool/tidep-0077, Jul. 10, 2017, pp. 1-3.

* cited by examiner

DIRECTIONAL ACOUSTIC SENSOR

CROSS-REFERENCE TO RELATED APPLICATION

This application is a divisional of Ser. No. 17/003,357, filed Aug. 26, 2020, which is based on claims priority under 35 U.S.C. § 119 to Korean Patent Application No. 10-2020-0004310, filed on Jan. 13, 2020, in the Korean Intellectual Property Office, the disclosure of which is incorporated by reference herein in its entirety.

BACKGROUND

1. Field

The disclosure relates to a directional acoustic sensor, and more particularly, to a directional acoustic sensor with an enhanced signal-to-noise ratio (SNR).

2. Description of Related Art

An acoustic sensor is mounted on household appliances, image display devices, virtual reality devices, augmented reality devices, artificial intelligence speakers, or the like, and is configured to detect the direction of sound and recognize voice. The acoustic sensor may include a directional acoustic sensor that detects an acoustic signal by converting a mechanical movement caused by a pressure difference into an electrical signal.

SUMMARY

Provided is a directional acoustic sensor with an enhanced signal-to-noise ratio.

According to an aspect of an example embodiment, a directional acoustic sensor may include a first sensing device configured to generate different output gains based on different input directions of external energy, and configured to generate at least one first output signal having a first polarity based on external energy received from an input direction; a second sensing device configured to generate different output gains based on different input directions of external energy, and configured to generate at least one second output signal having a second polarity, that is different than the first polarity, based on the external energy received from the input direction; and at least one signal processor configured to generate at least one final output signal based on the at least one first output signal and the at least one second output signal.

The first sensing device has the same directivity as the second sensing device.

The first sensing device is provided on a first substrate and comprises at least one first resonator configured to generate the at least one first output signal, and the second sensing device is provided on a second substrate and comprises at least one second resonator configured to generate the at least one second output signal.

At least one first support on which the at least one first resonator is provided extends from the first substrate, and at least one second support on which the at least one second resonator is provided extends from the second substrate.

The first and second sensing devices are stacked in a direction.

The first support comprises a first surface and a second surface opposite to the first surface, and the second support comprises a third surface facing the second surface and a fourth surface opposite to the third surface.

The first resonator comprises a first electrode provided on the first surface, a first piezoelectric layer provided on the first electrode, and a second electrode provided on the first piezoelectric layer, and the second resonator comprises a third electrode provided on the fourth surface and having the same polarity as the first electrode, a second piezoelectric layer provided on the third electrode, and a fourth electrode provided on the second piezoelectric layer and having the same polarity as the second electrode.

A first terminal electrically connected to the first electrode, and a second terminal electrically connected to the second electrode are provided on the first substrate, and a third terminal electrically connected to the third electrode, and a fourth terminal electrically connected to the fourth electrode are provided on the second substrate.

The first resonator comprises a first electrode provided on the second surface, a first piezoelectric layer provided on the first electrode, and a second electrode provided on the first piezoelectric layer, and the second resonator comprises a third electrode provided on the third surface and having the same polarity as the first electrode, a second piezoelectric layer provided on the third electrode, and a fourth electrode provided on the second piezoelectric layer and having the same polarity as the second electrode.

The first resonator comprises a first electrode provided on the first surface, a first piezoelectric layer provided on the first electrode, and a second electrode provided on the first piezoelectric layer, and the second resonator comprises a third electrode provided on the third surface and having the same polarity as the second electrode, a second piezoelectric layer provided on the third electrode, and a fourth electrode provided on the second piezoelectric layer and having the same polarity as the first electrode.

The first sensing device and the second sensing device are provided on the same plane.

The first substrate and the second substrate are provided integrally with each other or apart from each other.

The first resonator comprises a first electrode provided on a surface of the first support, a first piezoelectric layer provided on the first electrode, and a second electrode provided on the first piezoelectric layer, and the second resonator comprises a third electrode provided on a surface of the second support and having the same polarity as the second electrode, a second piezoelectric layer provided on the third electrode, and a fourth electrode provided on the second piezoelectric layer and having the same polarity as the first electrode.

The first sensing device comprises a plurality of first resonators configured to respectively generate a plurality of first output signals having different center frequencies, and the second sensing device comprises a plurality of second resonators configured to respectively generate a plurality of second output signals having different center frequencies corresponding to the plurality of first resonators.

A pair of a first resonator and a second resonator having the same center frequency and corresponding to each other are configured to respectively generate the first output signals and the second output signals of different polarities with respect to the external energy received from the input direction.

The at least one signal processor comprises a plurality of signal processors configured to respectively generate a plurality of final output signals based on the plurality of first output signals and the plurality of second output signals.

The at least one signal processor comprises a single signal processor configured to generate a single final output signal based on the plurality of first output signals and the plurality of second output signals.

A directional acoustic sensor may include a substrate; at least one first resonator configured to generate different output gains based on different input directions of external energy, and configured to generate at least one first output signal having a first polarity based on external energy received from an input direction; at least one second resonator configured to generate different output gains based on different input directions of external energy, and configured to generate at least one second output signal having a second polarity, that is different than the first polarity, based on the external energy received from the input direction; and at least one signal processor configured to generate at least one final output signal based on the at least one first output signal and the at least one second output signal, wherein the at least one first resonator and the at least one second resonator are stacked on the substrate in a single direction.

At least one support, on which the at least one first resonator and the at least one second resonator are provided, extends from the substrate.

The first resonator comprises a first electrode provided on a first surface of the support, a first piezoelectric layer provided on the first electrode, and a second electrode provided on the first piezoelectric layer, and the second resonator comprises the second electrode, a second piezoelectric layer provided on the second electrode, and a third electrode provided on the second piezoelectric layer and having the same polarity as the first electrode.

A first terminal electrically connected to the first electrode, a second terminal electrically connected to the second electrode, and a third terminal electrically connected to the third electrode are provided on a first surface of the substrate.

The first resonator comprises a first electrode provided on a first surface of the support, a first piezoelectric layer provided on the first electrode, and a second electrode provided on the first piezoelectric layer, and the second resonator comprises a third electrode provided on a second surface of the support and having the same polarity as the first electrode, a second piezoelectric layer provided on the third electrode, and a fourth electrode provided on the second piezoelectric layer and having the same polarity as the second electrode.

A first terminal electrically connected to the first electrode, and a second terminal electrically connected to the second electrode are provided on a first surface of the substrate, and a third terminal electrically connected to the third electrode, and a fourth terminal electrically connected to the fourth electrode are provided on a second surface of the substrate.

The at least one first resonator comprises a plurality of first resonators configured to respectively generate a plurality of first output signals having different center frequencies, and the at least one second resonator comprises a plurality of second resonators configured to respectively generate a plurality of second output signals having different center frequencies corresponding to the plurality of first resonators.

A pair of a first resonator and a second resonator having the same center frequency and corresponding to each other are configured to respectively generate the first and second output signals of different polarities with respect to the same input direction.

The at least one signal processor comprises a plurality of signal processors configured to respectively generate a plurality of final output signals based on the plurality of first output signals and the plurality of second output signals.

The at least one signal processor comprises a single signal processor configured to generate a single final output signal based on the plurality of first output signals and the plurality of second output signals.

An acoustic sensor may include a first sensing device configured to generate a first output signal of a first polarity in response to an external sound input; a second sensing device configured to generate a second output signal of a different polarity from the first polarity in response to the external sound input; and a signal processor configured to subtract the first output signal and the second output signal.

The first output signal and the second output signal have reverse phases as compared to each other.

The first sensing device and the second sensing device are stacked on each other.

The first sensing device and the second sensing device are disposed on a same plane.

The first sensing device and the second sensing device are stacked on each other, and share a common electrode.

The first sensing device and the second sensing device have a same directivity.

The first sensing device comprises a first resonator, and the second sensing device comprises a second resonator.

The first resonator faces the second resonator.

The first resonator is disposed in a different direction as compared to the second resonator.

The first resonator has a same center frequency as the second resonator.

Each of the first resonator and the second resonator comprises a pair of electrodes and a piezoelectric layer provided between the pair of electrodes.

The first sensing device comprises a plurality of first resonators having different center frequencies, and the second sensing device comprises a plurality of second resonators having different center frequencies corresponding to the plurality of first resonators.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
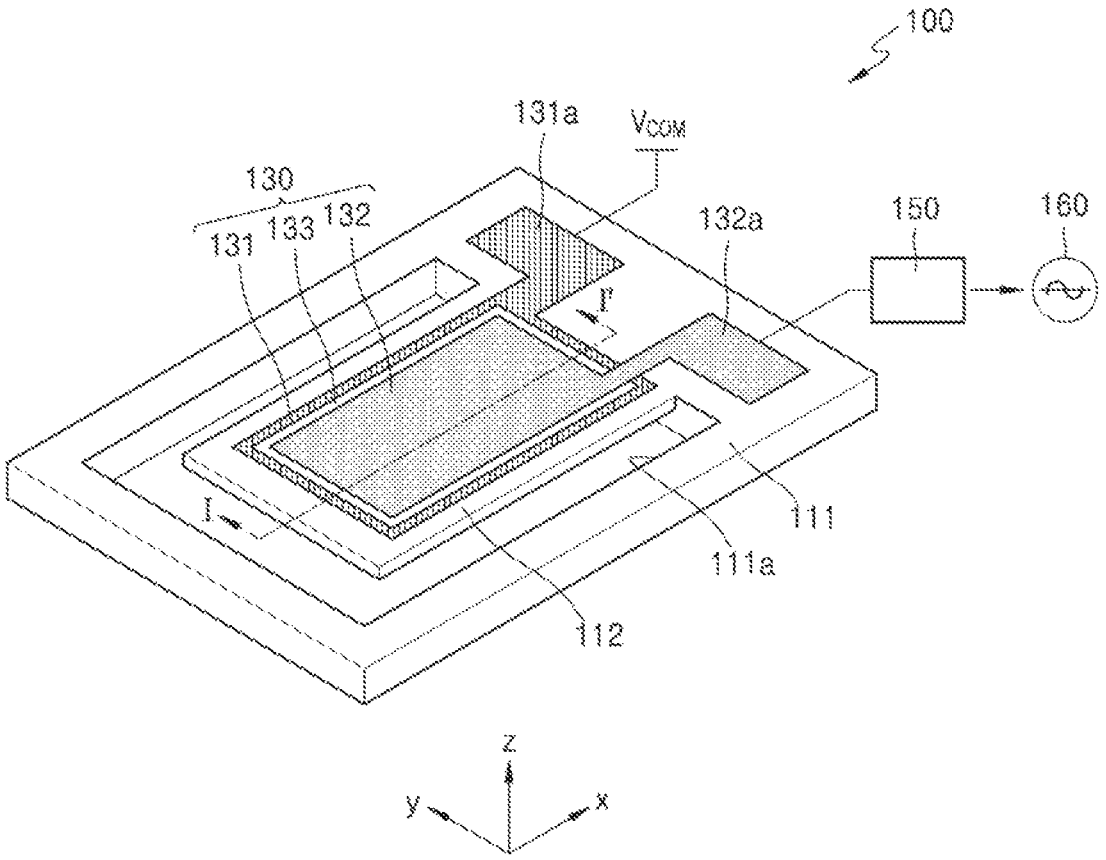
FIG. 1 is a perspective view of an example of a directional acoustic sensor.

Reference will now be made in detail to embodiments, examples of which are illustrated in the accompanying drawings, wherein like reference numerals refer to like elements throughout. In the drawings, the sizes of the constituent elements are exaggerated for clarity and convenience of explanation. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

In a layer structure, when a constituent element is disposed "above" or "on" another constituent element, the constituent element may be directly on, below, at the left of, or at the right of the other constituent element, or above, below, at the left of, or at the right of the other constituent elements in a non-contact manner. An expression used in a singular form in the specification also includes the expression in its plural form unless clearly specified otherwise in context. Also, terms such as "include" or "comprise" may be construed to denote a certain constituent element, but may not be construed to exclude the existence of or a possibility of addition of one or more other constituent elements.

The use of the terms "a" and "an" and "the" and similar referents in the context of describing the disclosure are to be construed to cover both the singular and the plural forms of the terms.

Also, the steps of all methods described herein can be performed in any suitable order unless otherwise indicated herein or otherwise clearly contradicted by context.

The use of any and all examples, or language (e.g., "such as") provided herein, is intended merely to better illuminate the disclosure and does not pose a limitation on the scope of the disclosure unless otherwise claimed.

Figure 2:
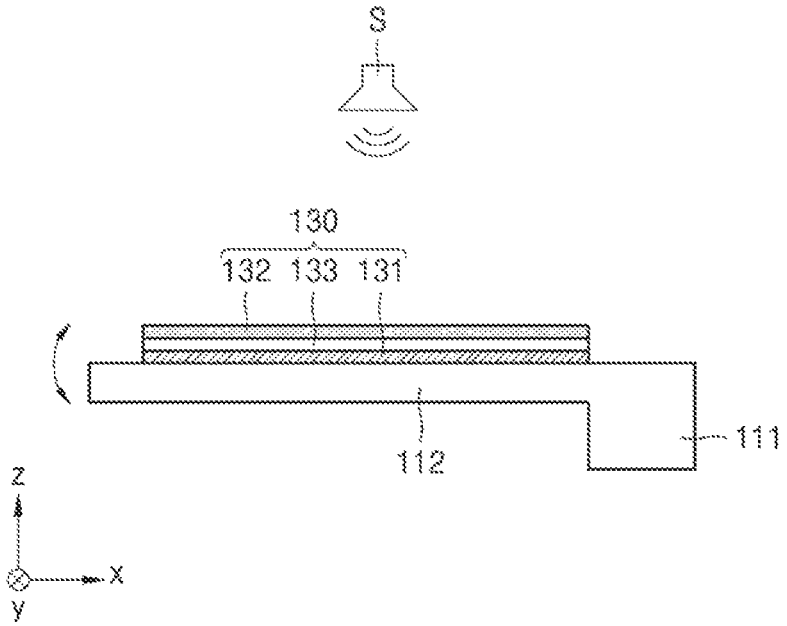
FIG. 2 is a cross-sectional view of the directional acoustic sensor taken along line I-I' of FIG. 1.

FIG. 1 is a perspective view of an example of a directional acoustic sensor 100. FIG. 2 is a cross-sectional view of the directional acoustic sensor 100, taken along line I-I' of FIG. 1.

Referring to FIGS. 1 and 2, the directional acoustic sensor 100 may include a resonator 130 provided on a substrate 111. A cavity 111*a* is formed in the substrate 111 by penetrating the same, and a support 112 extends from the substrate 111 toward the cavity 111*a*. An end portion of the support 112 is fixed to the substrate 111, and another end portion is provided to move in a vertical direction such as, for example, the z-axis direction as shown in FIG. 1. The substrate 111 may include, for example, a silicon substrate, but the present disclosure is not limited thereto and substrates including various other materials may be used therefor.

The resonator 130 is provided on the support 112. In detail, the resonator 130 may include a first electrode 131 provided on a surface of the support 112, a piezoelectric layer 133 provided on the first electrode 131, and a second electrode 132 provided on the piezoelectric layer 133. First and second terminals 131*a* and 132*a* respectively electrically connected to the first and second electrodes 131 and 132 may be provided on the substrate 111.

When external energy such as sound or pressure is input to the resonator 130, the piezoelectric layer 133 is deformed to generate electric energy. For example, when sound generated from a sound source S is input to the resonator 130 so that the piezoelectric layer 133 is deformed, electric energy may be generated between the first and second electrodes 131 and 132, and thus the electric energy may be output through the first and second terminals 131*a* and 132*a*. For example, when a common voltage $V_{com}$ is applied to the first terminal 131*a*, an output signal 160 may be obtained through a readout circuit 150 connected to the second terminal 132*a*.

The directional acoustic sensor 100 of FIG. 1 may have an output gain varying according to an input direction of external energy. In other words, the directional acoustic sensor 100 may have directionality and sensitivity that varies according to the input direction of external energy.

Figure 3A:
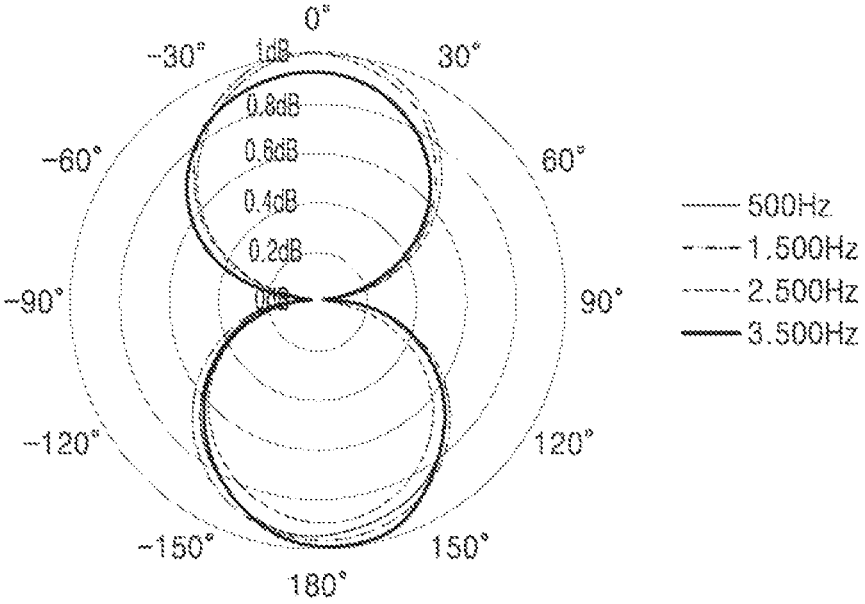
FIGS. 3A and 3B illustrate measurement results of the directional characteristics of the directional acoustic sensor of FIG. 1.
Figure 3B:
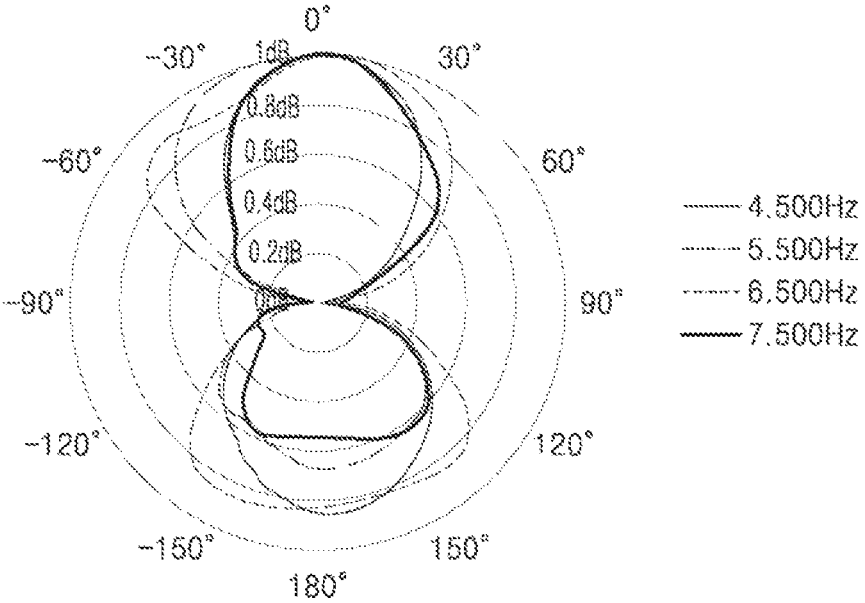

FIGS. 3A and 3B illustrate the measurement results of the directional characteristics of the directional acoustic sensor 100 of FIG. 1. As illustrated in FIGS. 3A and 3B, it may be seen that the directional acoustic sensor 100 has bi-directivity, that is, directivity in a z-axis direction of a 0° direction and a 180° direction.

Figure 4:
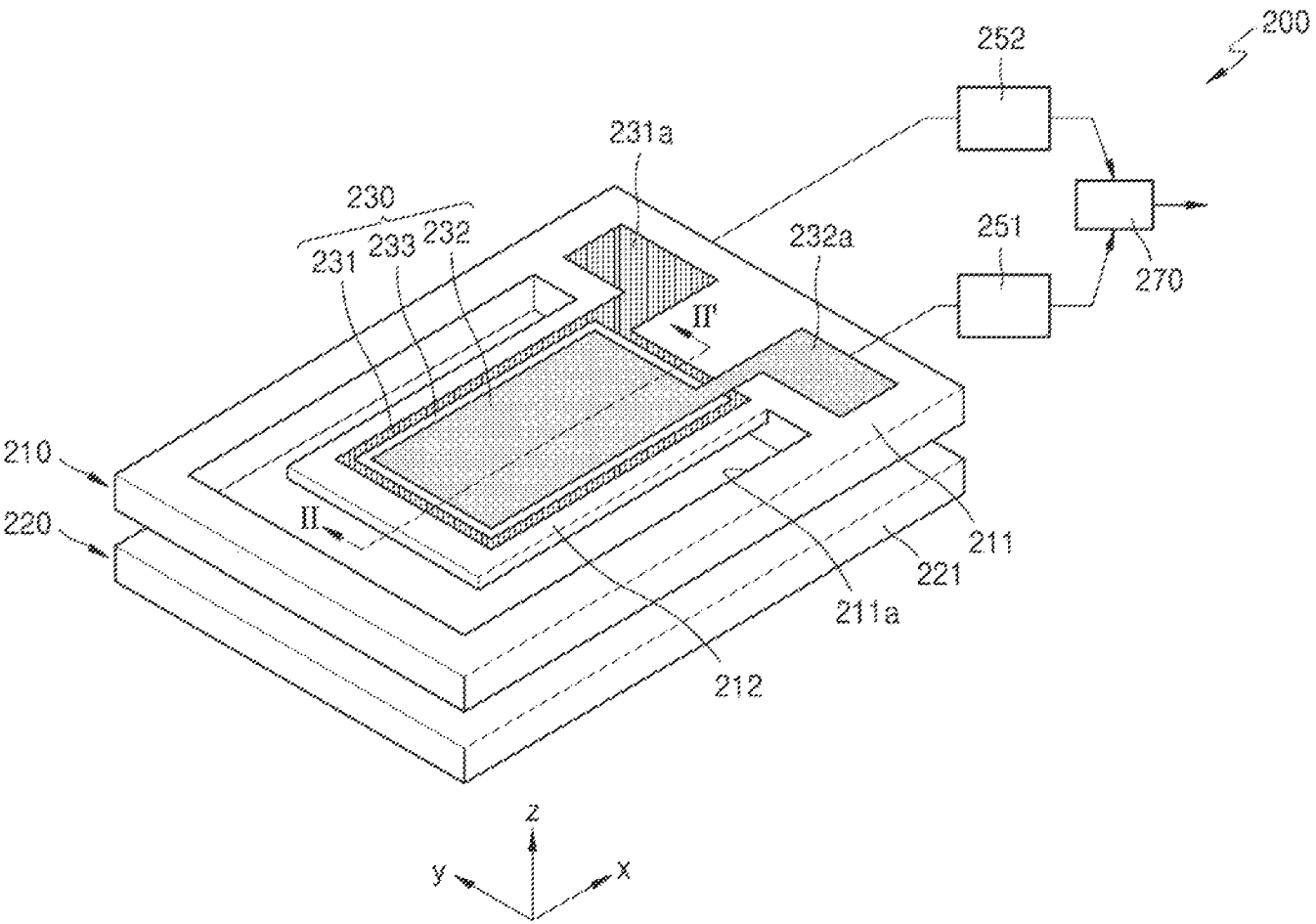
FIG. 4 is a perspective view of a directional acoustic sensor according to an embodiment.
Figure 5:
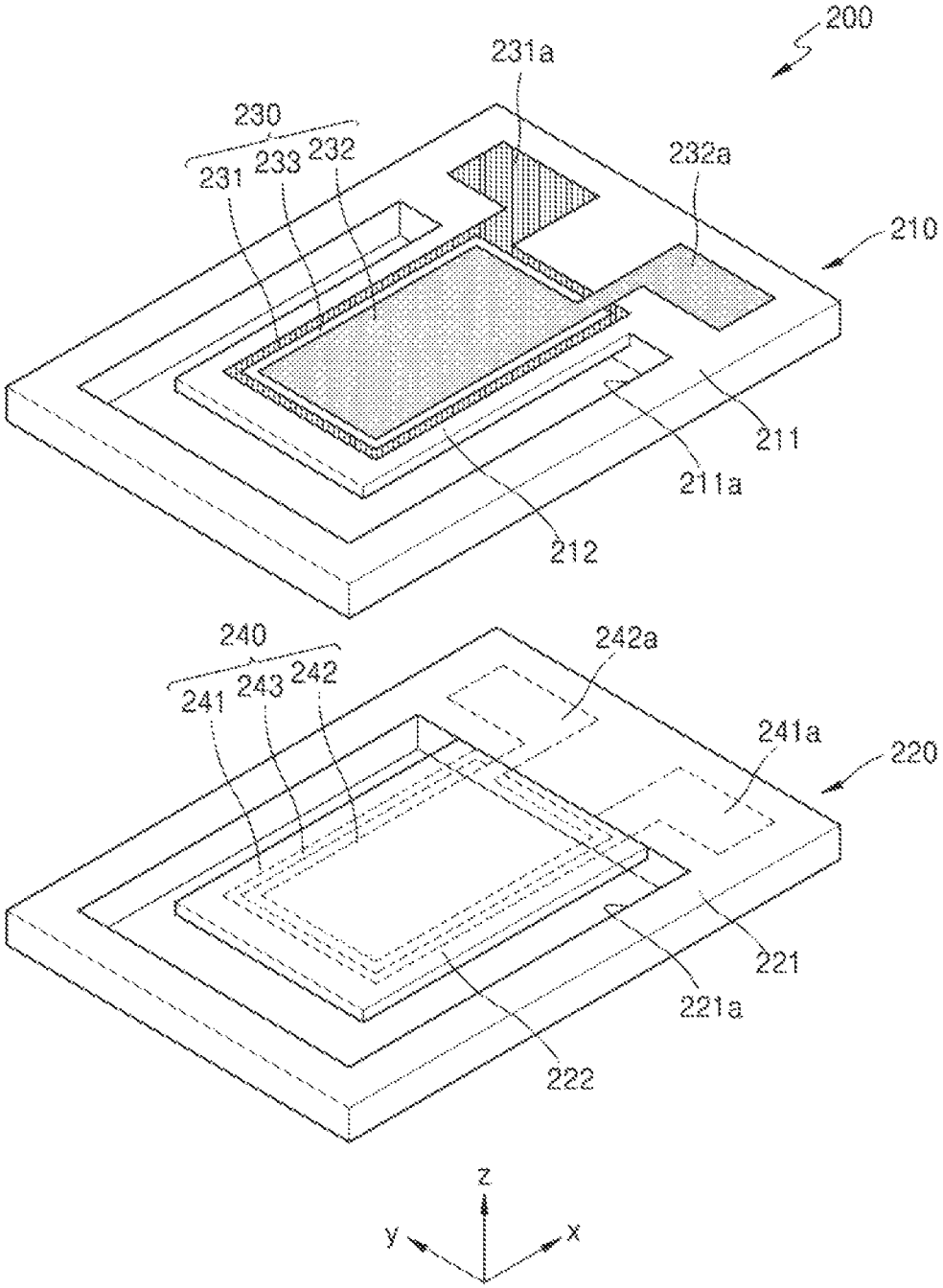
FIG. 5 is an exploded perspective view of the directional acoustic sensor of FIG. 4.
Figure 6:
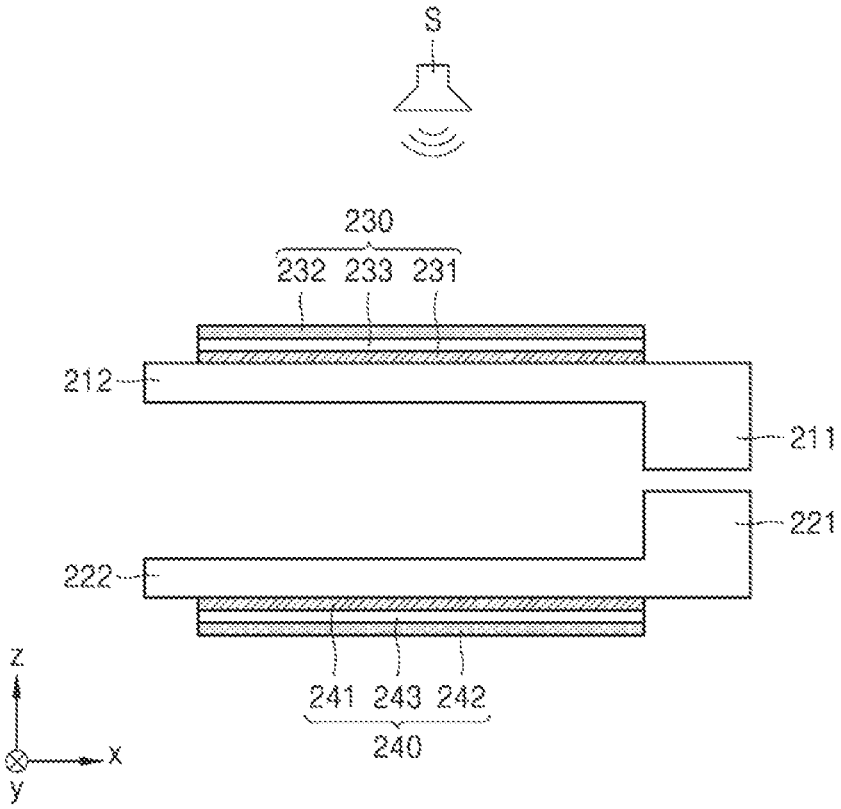
FIG. 6 is a cross-sectional view of the directional acoustic sensor taken along line II-II' of FIG. 4.
Figure 7:
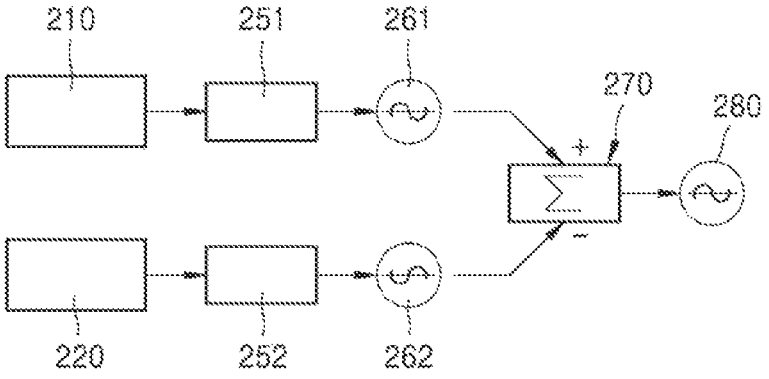
FIG. 7 is a block diagram of a schematic configuration of the directional acoustic sensor of FIG. 4.

FIG. 4 is a perspective view of a directional acoustic sensor 200 according to an embodiment. FIG. 5 is an exploded perspective view of the directional acoustic sensor 200 of FIG. 4. FIG. 6 is a cross-sectional view of the directional acoustic sensor 200, taken along line II-II' of FIG. 4. FIG. 7 is a block diagram of a schematic configuration of the directional acoustic sensor 200 of FIG. 4.

Referring to FIGS. 4 to 7, the directional acoustic sensor 200 may include first and second sensing devices 210 and 220 and a signal processor 270 for processing signals output from the first and second sensing devices 210 and 220. The first and second sensing devices 210 and 220 may generate output signals of different polarities in response to the same external sound input.

The first and second sensing devices 210 and 220 are stacked in one direction such as, for example, the z-axis direction as shown in FIG. 4. The first and second sensing devices 210 and 220 may be the same sensing device. For example, as shown in FIG. 4, the second sensing device 220 is illustrated to have the same shape as the first sensing device 210 flipped top to bottom.

The first sensing device 210 may include a first resonator 230 provided on a first substrate 211. The first resonator 230 may have a certain center frequency. The first substrate 211 has a first cavity 211*a* formed by penetrating the same, and a first support 212 extends from the first substrate 211 toward the first cavity 211*a*. An end portion of the first support 212 is fixed to the first substrate 211, and another end portion thereof is provided to move in a vertical direction such as, for example, the z-axis direction shown in FIG. 4. The first substrate 211 may include, for example, a silicon substrate, but the present disclosure is not limited thereto and substrates including various other materials may be used therefor.

The first resonator 230 is provided on the first support 212. In detail, the first resonator 230 may include a first electrode 231 provided on an upper surface of the first support 212, a first piezoelectric layer 233 provided on the first electrode 231, and a second electrode 232 provided on the first piezoelectric layer 233. The first and second electrodes 231 and 232 may be, for example, a positive (+) electrode and a negative (−) electrode, respectively. However, the present disclosure is not limited thereto, and the first and second electrodes 231 and 232 may be a negative (−) electrode and a positive (+) electrode, respectively The first and second terminals 231*a* and 232*a* are respectively electrically connected to the first and second electrodes 231 and 232, and may be provided on an upper surface of the first substrate 211. FIG. 4 illustrates an example case in which a first terminal 231*a* and a second terminal 232*a* are respectively located at the left and right sides on the upper surface of the first substrate 211 based on a direction facing a positive x axis. The first sensing device 210, like the directional acoustic sensor 100 of FIG. 1, may have bi-directivity such as, for example, in the z-axis direction as shown in FIG. 4.

The second sensing device 220 is provided under the first sensing device 210. As described above, the second sensing device 220 may have the same shape as the first sensing device 210 flipped top to bottom. The second sensing device 220 may include a second resonator 240 provided on the second substrate 221. The second resonator 240 may have the same center frequency as the first resonator 230. The second substrate 221 has a second cavity 221*a* formed by penetrating the same, and a second support 222 extends from the second substrate 221 toward the second cavity 221*a*. An end portion of the second support 222 is fixed to the second substrate 221, and another end portion thereof is movable in the vertical direction such as, for example, the z-axis direction as shown in FIG. 4.

The second resonator 240 is provided on the second support 222. In detail, the second resonator 240 may include a third electrode 241 provided on a lower surface of the second support 222, a second piezoelectric layer 243 provided on the third electrode 241, and a fourth electrode 242 provided on the second piezoelectric layer 243. Accordingly, the first and second resonators 230 and 240 may be arranged on the first and second supports 212 and 222, and may face each other in opposite directions. The third electrode 241 may have the same polarity as the first electrode 231, and the fourth electrode 242 may have the same polarity as the second electrode 232. For example, when the first and second electrodes 231 and 232 are a positive (+) electrode and a negative (−) electrode, respectively, the third and fourth electrodes 241 and 242 may be a positive (+) electrode and a negative (−) electrode, respectively.

Third and fourth terminals 241*a* and 242*a* are respectively electrically connected to the third and fourth electrodes 241 and 242, and may be provided on a lower surface of the second substrate 221. In FIG. 4, the third terminal 241*a* and the fourth terminal 242*a* are respectively located at the right and left sides on the lower surface of the second substrate 221 based on the direction facing the positive x axis. The second sensing device 220 may have the same directivity as the first sensing device 210.

The first and second sensing devices 210 and 220 may be arranged to operate in synchronism with an input of external energy. The first and second sensing devices 210 and 220 may be arranged with an interval of, for example, substantially 10 cm or less in a z-axis direction. For example, the first and second sensing devices 210 and 220 may be arranged with an interval of substantially 0 mm to 3 mm. However, this is merely exemplary and the interval between the first and second sensing devices 210 and 220 may vary. As such, when the first and second sensing devices 210 and 220 are arranged close to each other, the directional acoustic sensor 200 may be implemented to be compact.

When the external energy such as sound or pressure is input to the first and second resonators 230 and 240, electric energy may be generated from the first and second resonators 230 and 240. In detail, when sound generated from the sound source S is input to the first resonator 230, the first piezoelectric layer 233 is deformed so that electric energy may be generated between the first and second electrodes 231 and 232. The electric energy may be output as a first output signal 261 through a first readout circuit 251 connected to the first or second terminals 231*a* and 232*a*.

Further, when sound generated from the same sound source S is input to the second resonator 240, the second piezoelectric layer 243 is deformed so that electric energy may be generated between the third and fourth electrodes 241 and 242. The electric energy may be output as a second output signal 262 through a second readout circuit 252 connected to the third or fourth terminals 241*a* and 242*a*.

In the present embodiment, by configuring the first electrode 231 of the first resonator 230 and the third electrode 241 of the second resonator 240 to have the same polarity, and the second electrode 232 of the first resonator 230 and the fourth electrode 242 of the second resonator 240 to have the same polarity, the first and second resonators 230 and 240 may generate output signals of different polarities with respect to the same input direction of the external energy. In detail, the first and second resonators 230 and 240 may generate the first and second output signals 261 and 262 having reverse phases of different polarities.

The signal processor 270 may generate a final output signal 280 based on the first output signal 261 and the second output signal 262. For example, the signal processor 270 may generate a final output signal 280 by processing the first output signal 261 generated by the first resonator 230 and the second output signal 262 generated by the second resonator 240. As an example, the signal processor 270 may generate the final output signal 280 by calculating a difference of the first output signal 261 and the second output signal 262 of different polarities. In other words, the signal processor 270 may subtract the first output signal 261 from the second output signal 262. As another example, the signal processor 270 may alter a sign of one of the first output signal 261 and the second output signal 262, and then add the first output signal 261 and the second output signal 262. Accordingly, a signal-to-noise ratio (SNR) may be improved.

For instance, because the signs of the output signals generated by the first resonator 230 and the second resonator 240 are opposite to each other, when the difference between the first output signal 261 and the second output signal 262 is calculated, the external signal received by the first resonator 230 and the second resonator 240 is doubled, and a random noise or a typical noise from a circuit, which is not an external signal, is reduced.

In this way, the first resonator 230 and the second resonator 240 are combined to generate output signals of opposite polarities with regard to the same input signal, and the difference of the output signals is calculated to double the amplitude of the externally received input signals, and to reduce a random noise or a noise from a circuit.

The first and second output signals 261 and 262 generated by the first and second resonators 230 and 240 are generated by the behaviors of the first and second resonators 230 and 240, and the first and second output signals 261 and 262 each may generally include noise in a modulated form. The noise may include noise generated from a vibration body, intrinsic noise of a circuit, and noise caused by supplied power. The SNR may be improved when sensitivity of an acoustic sensor is increased while noise is reduced.

In the present embodiment, when the first and second resonators 230 and 240 generate the first and second output signals 261 and 262 of different polarities, and a difference between the first and second output signals 261 and 262 of different polarities is calculated by using the signal processor 270, a synchronized signal generated by the behaviors of the first and second resonators 230 and 240 may be increased and unsynchronized noise may be reduced. Accordingly, the final output signal 280 having an improved SNR may be obtained.

Figure 8A:
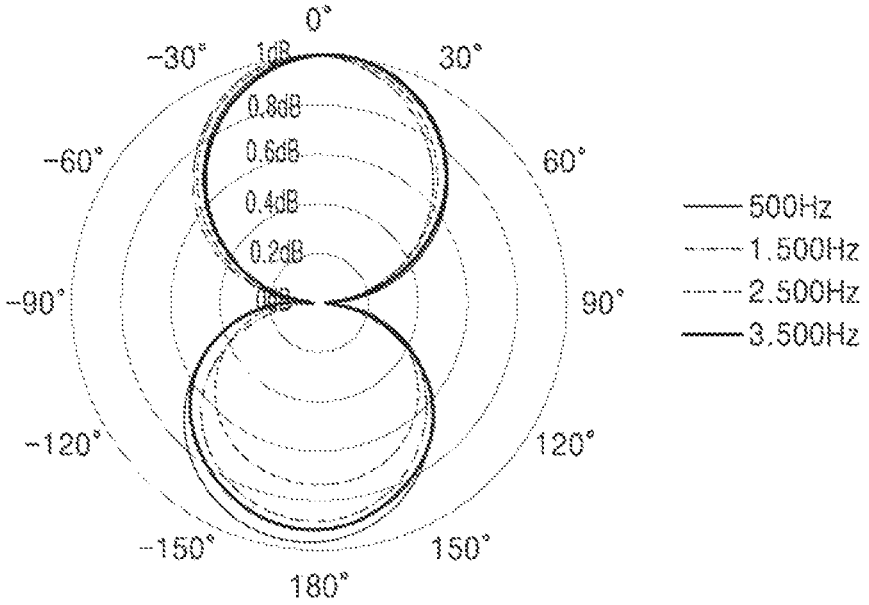
FIGS. 8A and 8B illustrate measurement results of the directional characteristics of the directional acoustic sensor of FIG. 4.
Figure 8B:
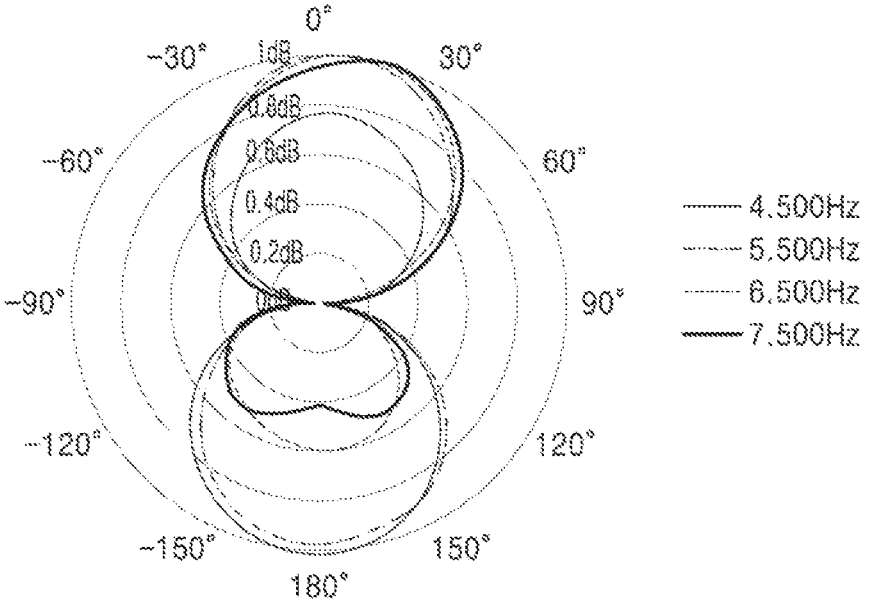

The directional acoustic sensor 200 including the first and second sensing devices 210 and 220 of FIG. 4 may have directivity having different output gains according to the input direction of the external energy. FIGS. 8A and 8B illustrate measurement results of the directional characteristics of the directional acoustic sensor 200 of FIG. 4. As illustrated in FIGS. 8A and 8B, it may be seen that the directional acoustic sensor 200 has bi-directivity, that is, directivity in the z-axis direction of a 0° direction and a 180° direction.

Figure 9A:
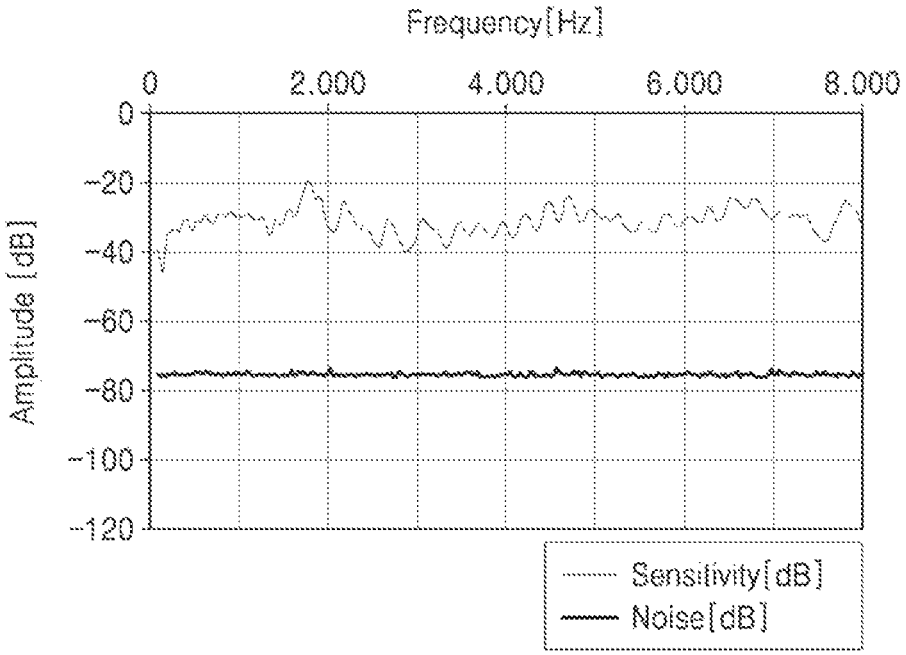
FIG. 9A is a graph showing measurement results of the frequency response characteristics of the directional acoustic sensor of FIG. 1.

FIG. 9A is a graph showing a measurement result of the frequency response characteristics of the directional acoustic sensor 100 of FIG. 1. Referring to FIG. 9A, an SNR of substantially 44.6 dB is measured in the directional acoustic sensor 100.

Figure 9B:
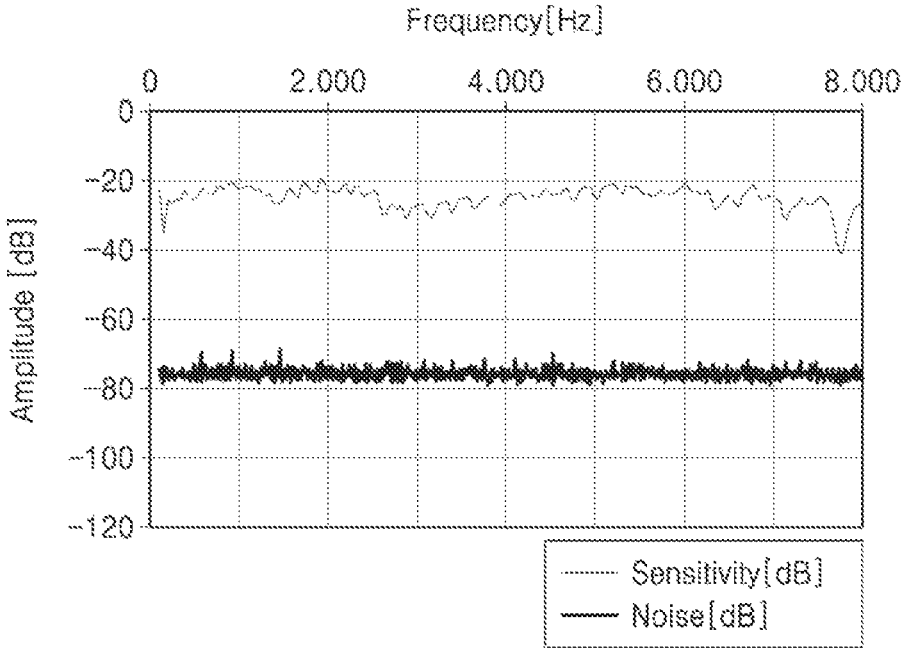
FIG. 9B is a graph showing measurement results of the frequency response characteristics of the directional acoustic sensor of FIG. 4.

FIG. 9B is a graph showing a measurement result of the frequency response characteristics of the directional acoustic sensor 200 of FIG. 4. Referring to FIG. 9B, it may be seen that, in the directional acoustic sensor 200 according to an embodiment, as the output is increased compared to the frequency response characteristics of the directional acoustic sensor 100 of FIG. 9A, sensitivity is improved and noise is also reduced. In the directional acoustic sensor 200 according to an embodiment, an SNR of substantially 51.6 dB is measured. It may be seen that, in the directional acoustic sensor 200 according to an embodiment, the SNR is increased by substantially 7 dB compared to the frequency response characteristics of the directional acoustic sensor 100 of FIG. 9A.

As such, in the directional acoustic sensor 200 according to an embodiment, the first and second resonators 230 and 240 may generate the first and second output signals 261 and 262 of different polarities, and SNR may be improved by calculating a difference of the first and second output signals 261 and 262 having different polarities by using the signal processor 270. Furthermore, as the first and second sensing devices 210 and 220 are arranged closed to each other, the directional acoustic sensor 200 may be implemented to be compact.

Figure 10:
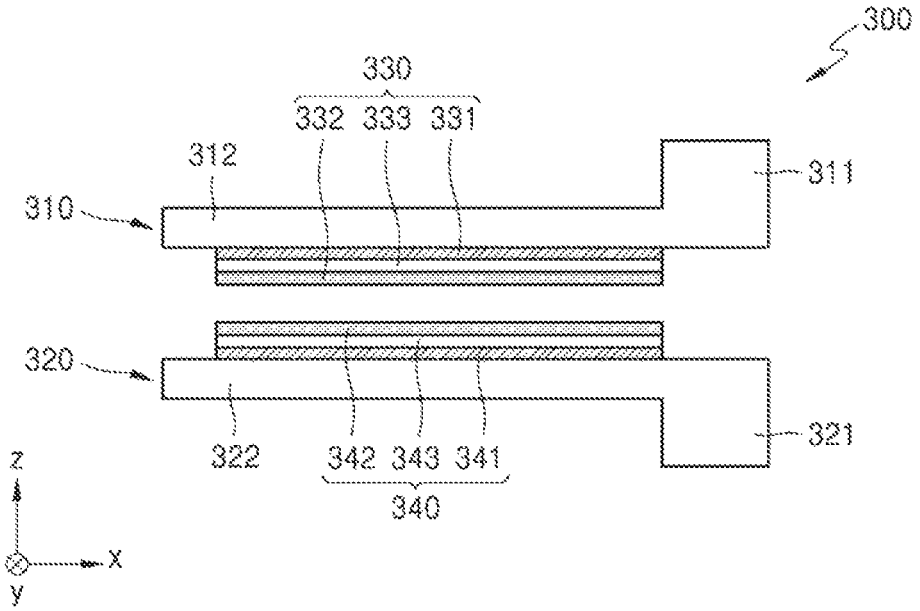
FIG. 10 illustrates a directional acoustic sensor according to another embodiment.

FIG. 10 illustrates a directional acoustic sensor 300 according to another embodiment.

Referring to FIG. 10, the directional acoustic sensor 300 may include first and second sensing devices 310 and 320 stacked in one direction, in which the first sensing device 310 is the same as the first sensing device 210 of FIG. 4 flipped top to bottom, and the second sensing device 320 is the same as the second sensing device 220 of FIG. 4 flipped top to bottom. In FIG. 10, first and second substrates 311 and 321 and first and second supports 312 and 322 are provided.

A first resonator 330 provided on the first substrate 311 and a second resonator 340 provided on the second substrate 321 are arranged to face each other. In detail, the first resonator 330 may include a first electrode 331 provided on a lower surface of the first support 312, a first piezoelectric layer 333 provided on the first electrode 331, and a second electrode 332 provided on the first piezoelectric layer 333. First and second terminals (not shown) electrically connected to the first and second electrodes 331 and 332 may be provided on the lower surface of the first substrate 311.

The second resonator 340 may include a third electrode 341 provided on an upper surface of the second support 322, a second piezoelectric layer 343 provided on the third electrode 341, and a fourth electrode 342 provided on the second piezoelectric layer 343. The third electrode 341 may have the same polarity as the first electrode 331, and the fourth electrode 342 may have the same polarity as the second electrode 332. Third and fourth terminals (not shown) electrically connected to the third and fourth electrodes 341 and 342 may be provided on an upper surface of the second substrate 311. Accordingly, the first and second resonators 330 and 340 may be arranged on the first and second supports 312 and 322 to face each other.

The first and second resonators 330 and 340 may generate first and second output signals having reverse phases of different polarities. As a signal processor (not shown) generates a final output signal by calculating a difference of the first output signal and the second output signal of different polarities, the SNR may be improved.

Figure 11:
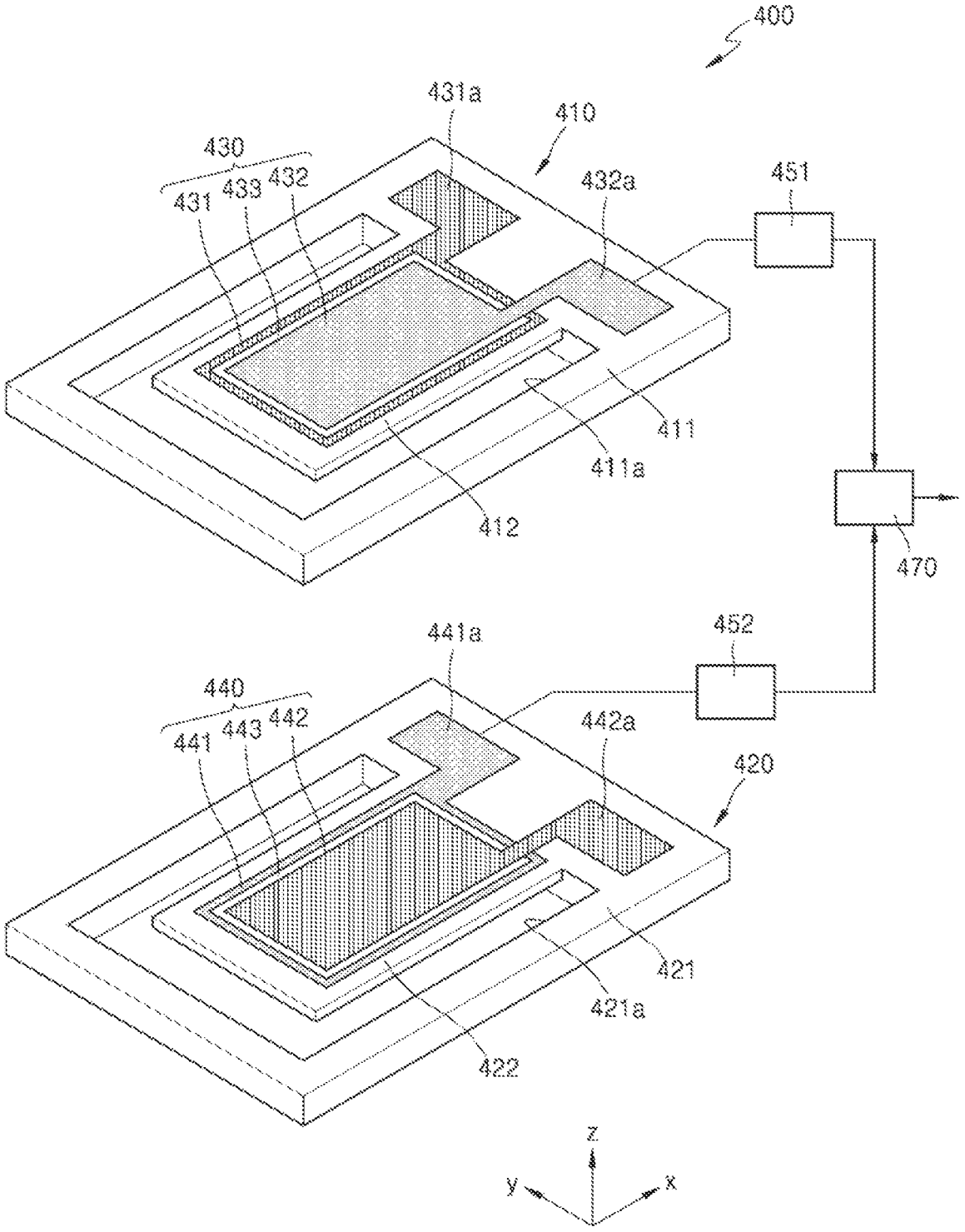
FIG. 11 is an exploded perspective view of a directional acoustic sensor according to another embodiment.
Figure 12:
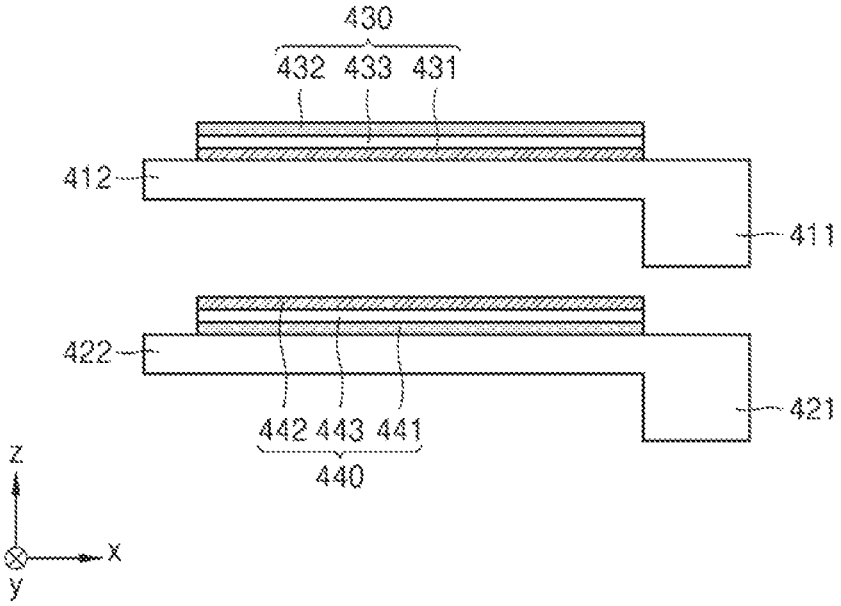
FIG. 12 is a cross-sectional view of the directional acoustic sensor of FIG. 11.

FIG. 11 is an exploded perspective view of a directional acoustic sensor 400 according to another embodiment. FIG. 12 is a cross-sectional view of the directional acoustic sensor 400 of FIG. 11.

Referring to FIGS. 11 and 12, the directional acoustic sensor 400 may include first and second sensing devices 410 and 420 stacked in one direction and a signal processor 470 for processing signals output from the first and second sensing devices 410 and 420.

The first sensing device 410 is the same as the first sensing device 210 of FIG. 4. In FIG. 11, a first substrate 411, a first cavity 411*a*, and a first support 412 are provided, and a first electrode 431, a second electrode 432, and a piezoelectric layer 433 of a first resonator 430 are provided. First and second terminals 431*a* and 431*b* are provided. FIG. 11 illustrated a case in which the first terminal 431*a* and the second terminal 432*a* are respectively located at the left and right sides on an upper surface of the first substrate 411 based on the direction facing the positive x-axis.

The second sensing device 420 provided under the first sensing device 410 is the same as the first sensing device 410, except that the polarities of the electrodes are opposite to each other. The second sensing device 420 may be manufactured by reversely wiring the first sensing device 410 and electrode terminals.

In FIG. 11, a second substrate 421, a second cavity 421*a*, and a second support 422 are provided. A second resonator 440 may include a third electrode 441 provided on an upper surface of the second support 422, a second piezoelectric layer 443 provided on the third electrode 441, and a fourth electrode 442 provided on the second piezoelectric layer 443. The first and second resonators 430 and 440 may be arranged on the first and second supports 412 and 422, facing in the same direction. The third electrode 441 may have the same polarity as the second electrode 432, and the fourth electrode 442 may have the same polarity as the first electrode 431. For example, when the first and second electrodes 431 and 432 are a positive (+) electrode and a negative (−) electrode, respectively, the third and fourth electrodes 441 and 442 may be a negative (−) electrode and a positive (+) electrode, respectively. Third and fourth terminals 441*a* and 442*a* electrically connected to the third and fourth electrodes 441 and 442 may be provided on an upper surface of the second substrate 421. FIG. 11 illustrates a case in which the third terminal 441*a* and the fourth terminal 442*a* are located at the left and right sides on the upper surface of the second substrate 421 based on the direction facing the positive x-axis.

In the present embodiment, as the first electrode 431 of the first resonator 430 and the fourth electrode 442 of the second resonator 440 are configured to have the same polarity, and the second electrode 432 of the first resonator 430 and the third electrode 441 of the second resonator 440 are configured to have the same polarity, the first and second resonators 430 and 440 may generate first and second output signal having reverse phases of different polarities through first and second readout circuits 451 and 452 with respect to the same input direction of the external energy.

The signal processor 470 may generate a final output signal based on the first output signal and the second output signal. For example, the signal processor 470 may generate a final output signal by calculating a difference of the first output signal and the second output signal of different polarities. In other words, the signal processor 470 may subtract the first output signal from the second output signal. As another example, the signal processor 470 may alter a sign of one of the first output signal and the second output signal, and then add the first output signal and the second output signal. Accordingly, a synchronized signal generated by behaviors of the first and second resonators 430 and 440 may be increased and unsynchronized noise may be reduced, thereby improving the SNR.

For instance, because the signs of the output signals generated by the first resonator 430 and the second resonator 440 are opposite to each other, when the difference between the first output signal and the second output signal is calculated, the external signal received by the first resonator 430 and the second resonator 440 is doubled, and a random noise or a typical noise from a circuit, which is not an external signal, is reduced.

In this way, the first resonator 430 and the second resonator 440 are combined to generate output signals of opposite polarities with regard to the same input signal, and the difference of the output signals is calculated to double the amplitude of the externally received input signals, and to reduce a random noise or a noise from a circuit.

Figure 13:
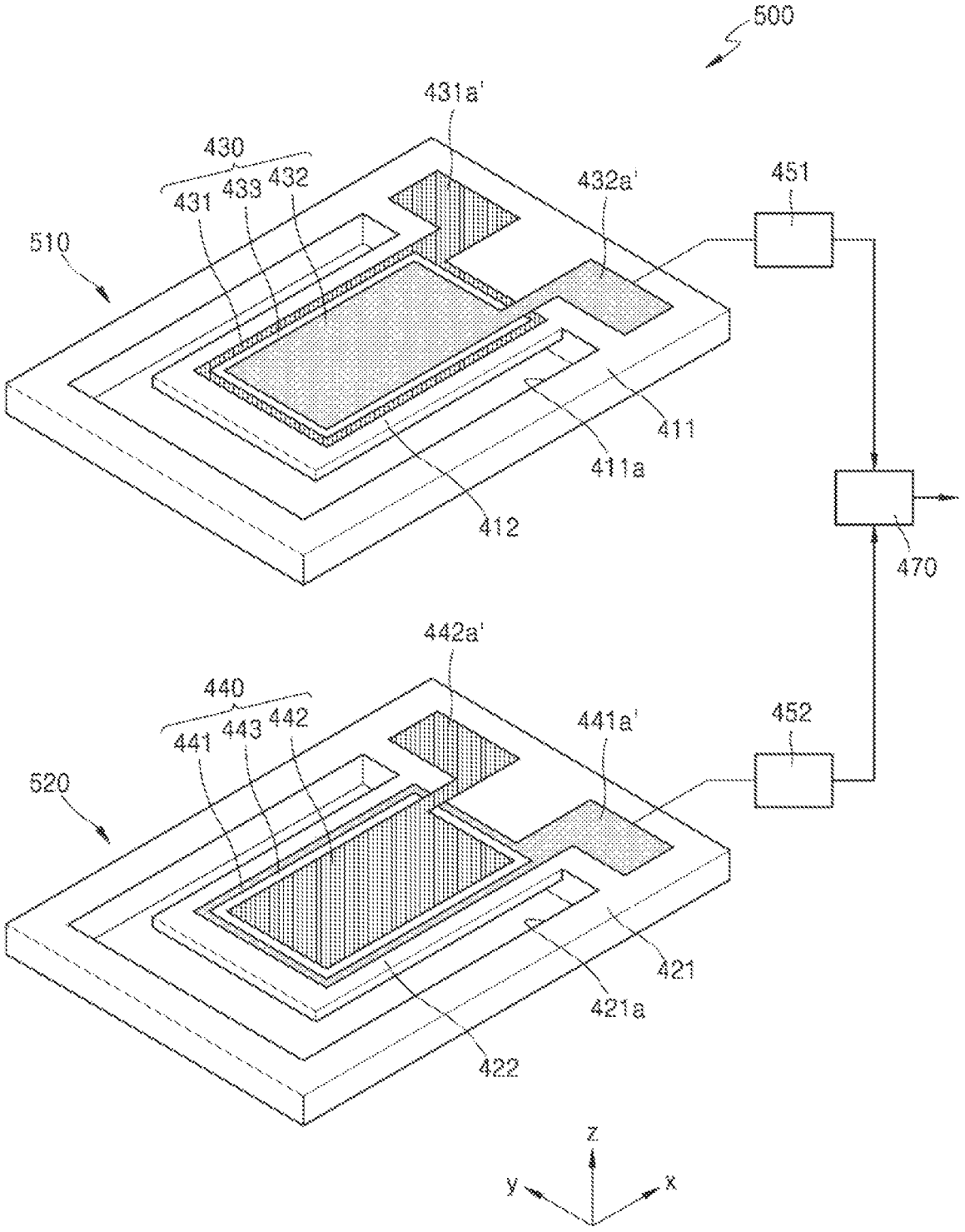
FIG. 13 is an exploded perspective view of a directional acoustic sensor according to another embodiment.

FIG. 13 is an exploded perspective view of a directional acoustic sensor 500 according to another embodiment. The directional acoustic sensor 500 of FIG. 13 is the same as the directional acoustic sensor 400 of FIG. 11, except the locations of electrode terminals.

Referring to FIG. 13, a first sensing device 510 is the same as the first sensing device 410 of FIG. 11. First and second terminals 431*a*' and 432*a*' of the first sensing device 510 are respectively located at the left and right sides on the upper surface of the first substrate 411 based on the direction facing the +x axis. Third and fourth terminals 441*a*' and 442*a*' of a second sensing device 520 are respectively located at the right and left sides on the upper surface of the second substrate 421. Accordingly, second and third terminals 432*a*' and 441*a*' having the same polarity may be arranged in the same direction, for example, the z-axis direction, and the first and fourth terminals 431*a*' and 442*a*' having the same polarity may be arranged in the same direction.

Figure 14:
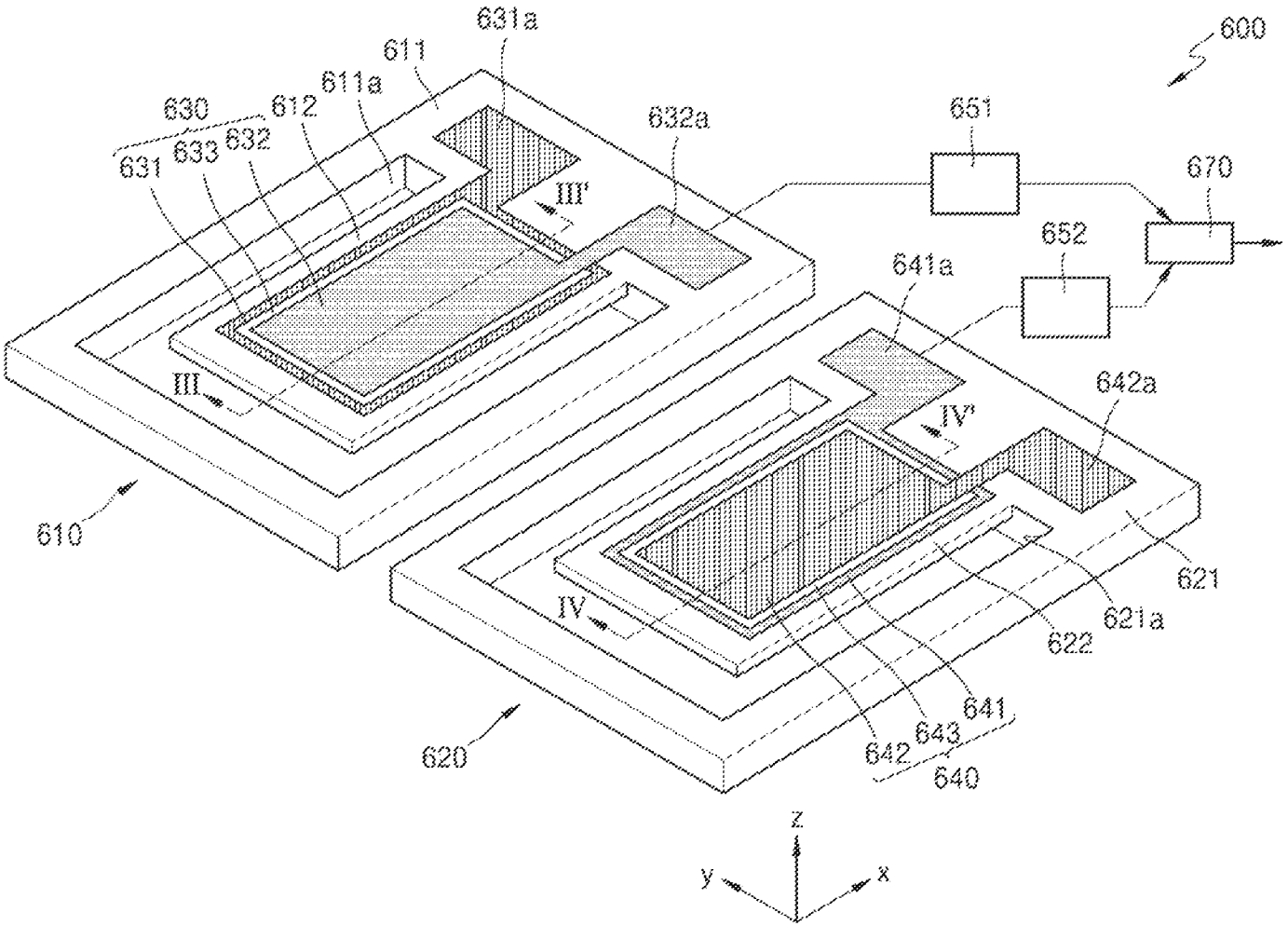
FIG. 14 is a perspective view of a directional acoustic sensor according to another embodiment.
Figure 15A:
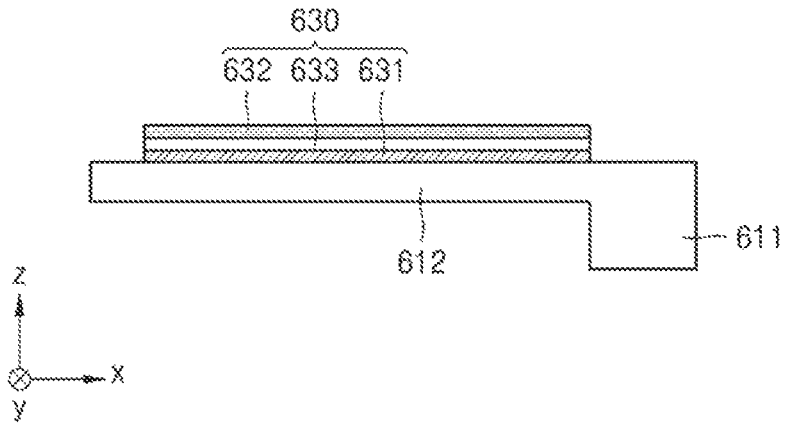
FIG. 15A is a cross-sectional view of the directional acoustic sensor taken along line III-III' of FIG. 14.
Figure 15B:
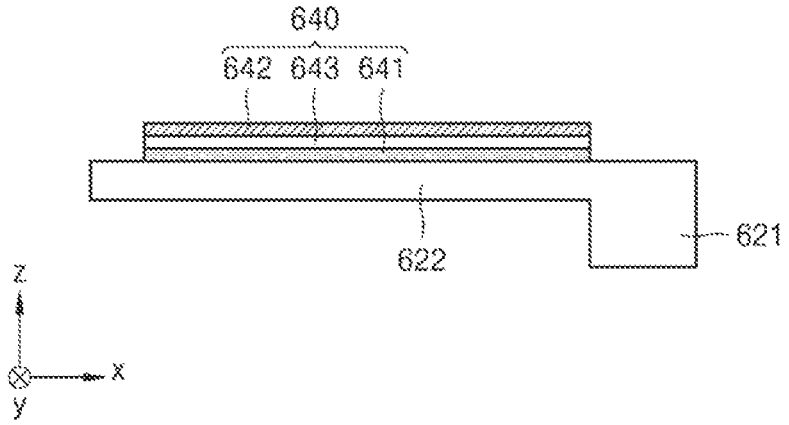
FIG. 15B is a cross-sectional view of the directional acoustic sensor taken along line IV-IV' of FIG. 14.

FIG. 14 is a perspective view of a directional acoustic sensor 600 according to another embodiment. FIG. 15A is a cross-sectional view of the directional acoustic sensor 600, taken along line III-III' of FIG. 14. FIG. 15B is a cross-sectional view of the directional acoustic sensor 600, taken along line IV-IV' of FIG. 14. The directional acoustic sensor 600 of FIG. 14 is the same as the directional acoustic sensor of FIG. 11, except that first and second sensing devices 610 and 620 are disposed on the same plane.

Referring to FIGS. 14, 15A, and 15B, the directional acoustic sensor 600 may include the first and second sensing devices 610 and 620 disposed on the same plane and a signal processor 670 for processing signals output from the first and second sensing devices 610 and 620. The first and second sensing devices 610 and 620 may be disposed to operate in synchronism with an input of external energy. The first and second sensing devices 610 and 620 may be disposed at an interval of, for example, about 10 cm or less, on a plane, in detail about 0 cm to about 1 cm, on a plane, but this is mere exemplary. The first sensing device 610 is the same as the first sensing device 410 of FIG. 11. In FIG. 14, a first substrate 611, a first cavity 611*a*, and a first support 612 are provided, and a first electrode 631, a second electrode 632, and a piezoelectric layer 633 of a first resonator 630 are provided. First and second terminals 631*a* and 631*b* are provided.

The second sensing device 620 is provided adjacent to the first sensing device 610 on the same plane, for example, an x-y plane. The second sensing device 620 is the same as the second sensing device 420 of FIG. 11. In other words, the second sensing device 620 is the same as the first sensing device 610, except that the polarities of electrodes are opposite to each other. In FIG. 14, a second substrate 621, a second cavity 621*a*, and a second support 622 are provided, and a first electrode 641, a second electrode 642, and a piezoelectric layer 643 of a second resonator 640 are provided. First and second terminals 641*a* and 641*b* are provided. The second sensing device 620 may be manufactured by reversely wiring the first sensing device 610 and the electrode terminals. The first resonator 630 of the first sensing device 610 and the second resonator 640 of the second sensing device 620 may have the same center frequency.

The directional acoustic sensor 600 according to the present embodiment may be implemented by disposing the first and second sensing devices 410 and 420 of the directional acoustic sensor 400 of FIG. 11 on the same plane. Furthermore, a directional acoustic sensor may be implemented by providing the first and second sensing devices 510 and 520 of the directional acoustic sensor 500 of FIG. 13 on the same plane.

Figure 16:
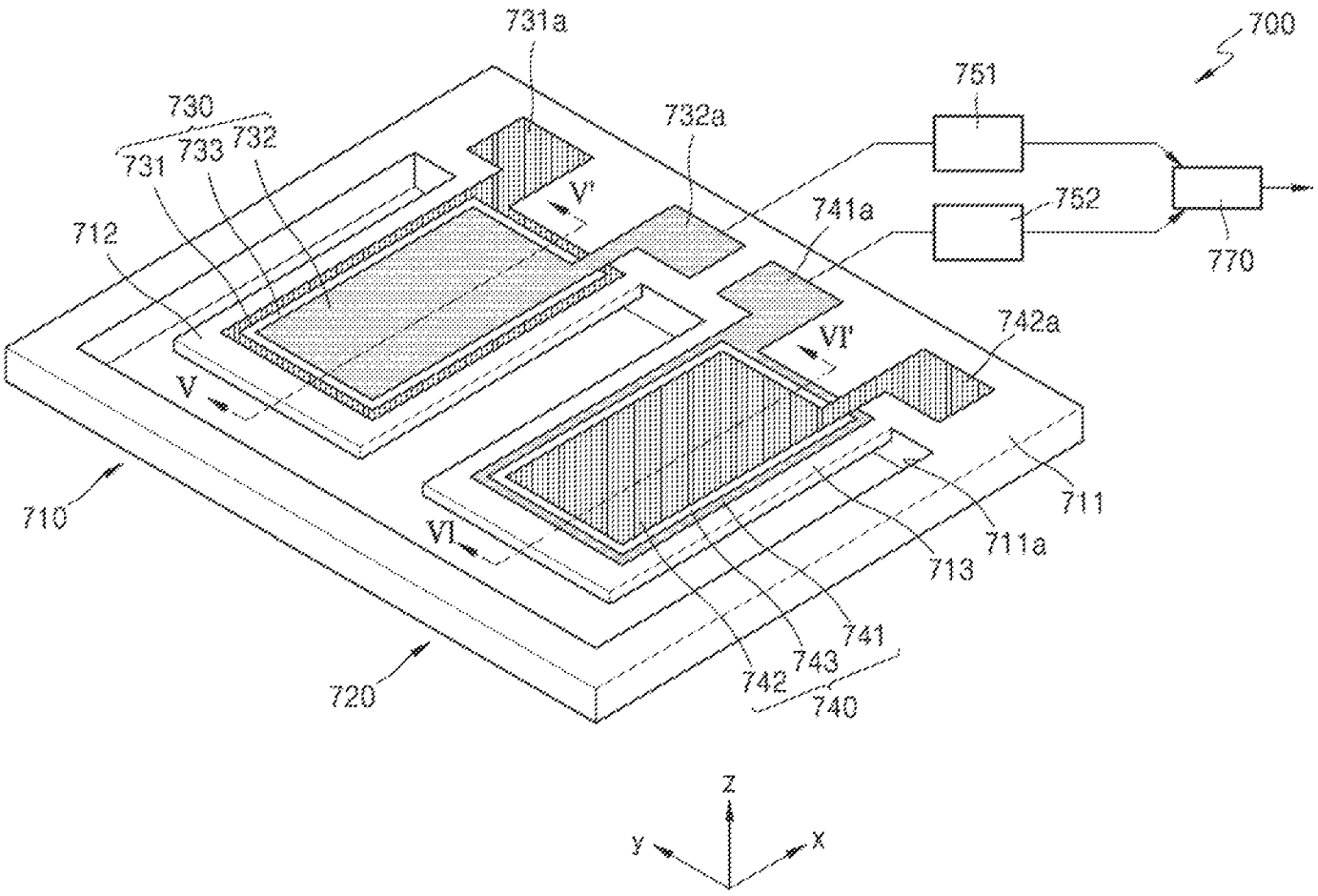
FIG. 16 is a perspective view of a directional acoustic sensor according to another embodiment.
Figure 17A:
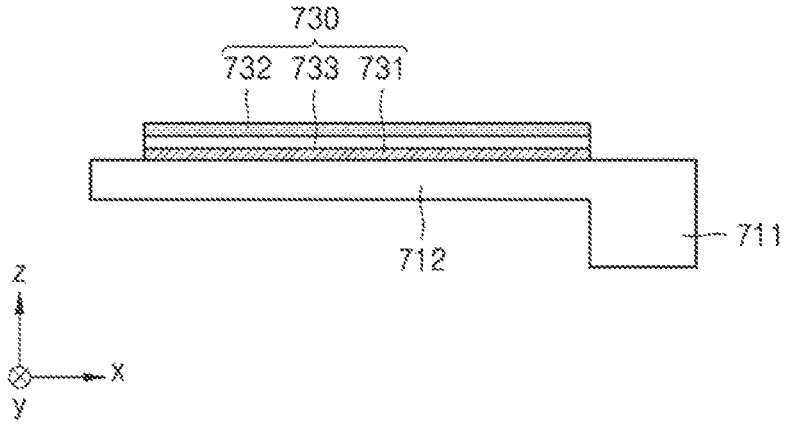
FIG. 17A is a cross-sectional view of the directional acoustic sensor taken along line V-V' of FIG. 16.
Figure 17B:
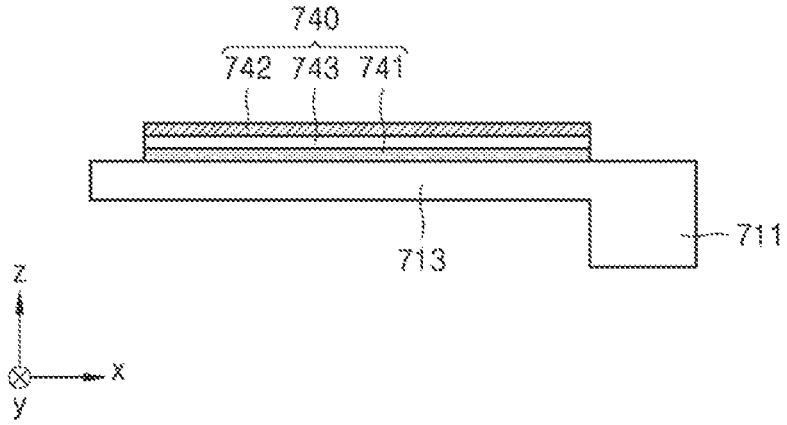
FIG. 17B is a cross-sectional view of the directional acoustic sensor taken along line VI-VI' of FIG. 16.

FIG. 16 is a perspective view of a directional acoustic sensor 700 according to another embodiment. FIG. 17A is a cross-sectional view of the directional acoustic sensor 700, taken along line V-V' of FIG. 16. FIG. 17B is a cross-sectional view of the directional acoustic sensor 700, taken along line VI-VI' of FIG. 16. The directional acoustic sensor 700 of FIG. 16 is the same as the directional acoustic sensor 600 of FIG. 14, except that first and second sensing devices 710 and 720 are integrally provided.

Referring to FIGS. 16, 17A, and 17B, the directional acoustic sensor 700 may include the first and second sensing devices 710 and 720 integrally formed on the same plane and a signal processor 770 for processing signals output from the first and second sensing devices 710 and 720. The first and second sensing devices 710 and 720 may be arranged to operate in synchronism with an input of external energy.

A cavity 711*a* is formed in a substrate 711 by penetrating the same, and the first and second supports 712 and 713 extending toward the cavity 711*a* is provided on the substrate 711. The first sensing device 710 may be provided on the first support 712, and a second sensing device 720 may be provided on the second support 713.

The first sensing device 710 may include a first resonator 730, and the first resonator 730 may include a first electrode 731 provided on an upper surface of the first support 712, a first piezoelectric layer 733 provided on the first electrode 731, and a second electrode 732 provided on the first piezoelectric layer 733. First and second terminals 731*a* and 732*a* respectively electrically connected to the first and second electrodes 731 and 732 may be provided on an upper surface of the substrate 711 at one side.

The second sensing device 720 may include a second resonator 740, and the second resonator 740 may include a third electrode 741 provided on an upper surface of the second support 713, a second piezoelectric layer 743 provided on the third electrode 741, and a fourth electrode 742 provided on the second piezoelectric layer 743. The third electrode 741 may have the same polarity as the second electrode 732, and the fourth electrode 742 may have the same polarity as the first electrode 731. Third and fourth terminals 741*a* and 742*a* respectively electrically connected to the third and fourth electrodes 741 and 742 may be provided on the upper surface of the substrate 711 at the other side.

Figure 18:
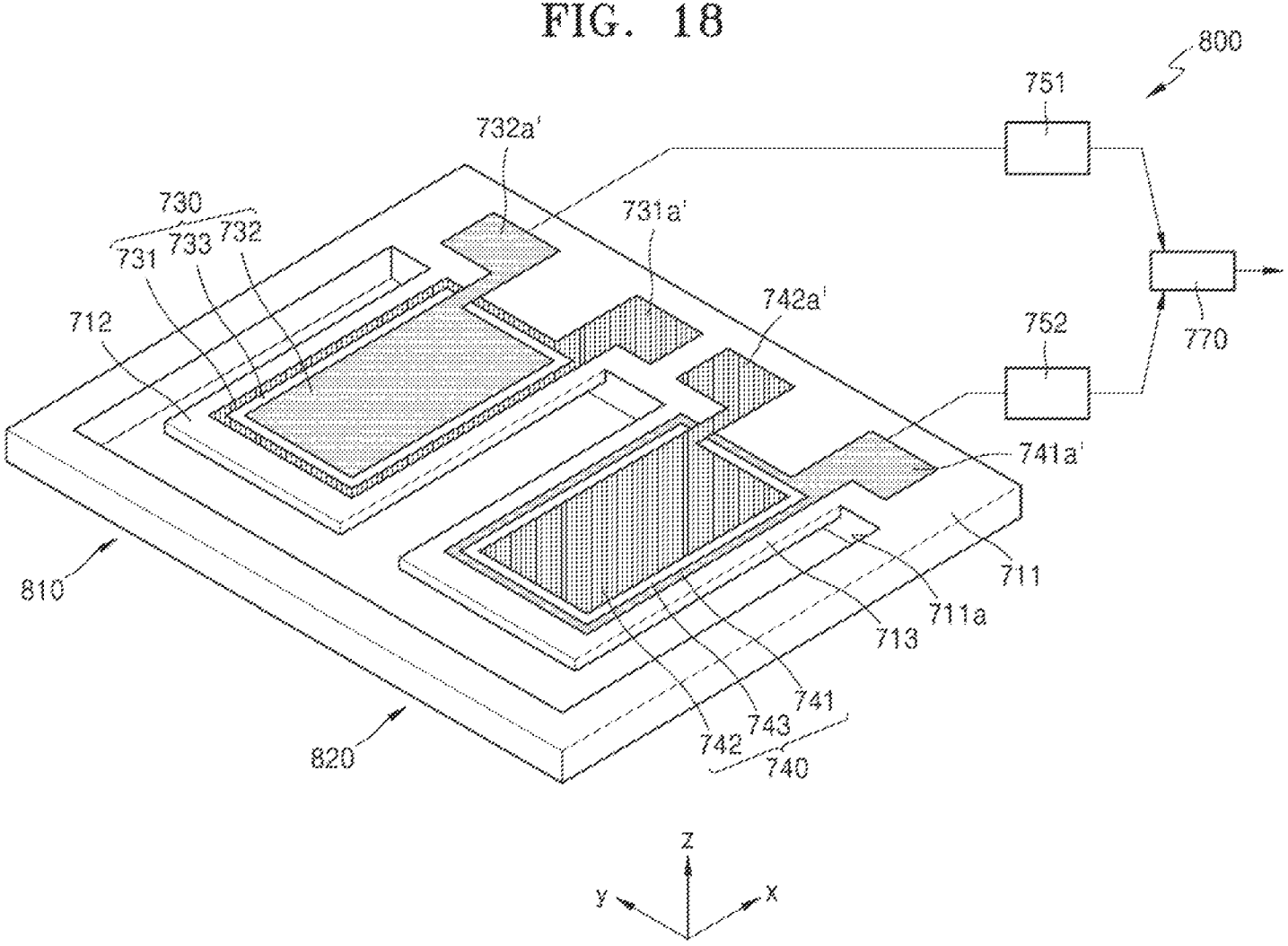
FIG. 18 is a perspective view of a directional acoustic sensor according to another embodiment.

FIG. 18 is a perspective view of a directional acoustic sensor 800 according to another embodiment. The directional acoustic sensor 800 of FIG. 18 is the same as the directional acoustic sensor 700 of FIG. 16, except the locations of electrode terminals.

Referring to FIG. 18, a first sensing device 810 is the same as the first sensing device 710 of FIG. 16. First and second terminals 731*a*' and 732*a*' of the first sensing device 810 are respectively located at the right and left sides of the substrate 711 based on the direction facing the +x axis. Third and fourth terminals 741*a*' and 742*a*' of a second sensing device 820 are respectively located at the right and left sides on the upper surface of the substrate 711 at the right side.

Figure 19A:
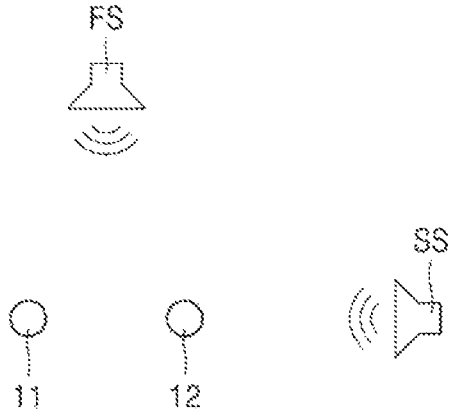
FIGS. 19A to 19C schematically illustrate an acoustic sensor according to the related art and a directional acoustic sensor according to an embodiment used as test models in a wake-up test.
Figure 19B:
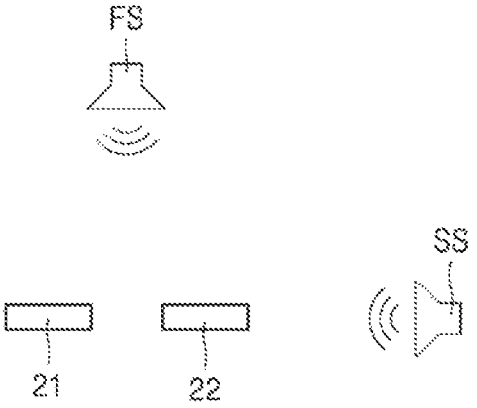
Figure 19C:
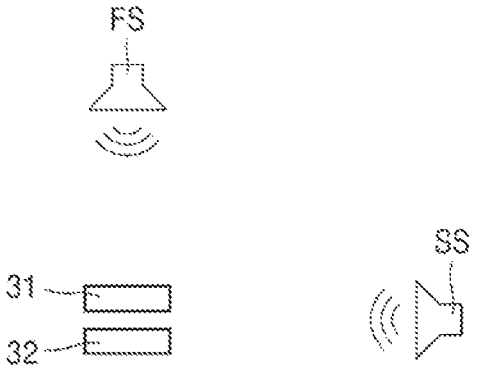

FIGS. 19A to 19C schematically illustrate an acoustic sensor according to the related art and directional acoustic sensors according to an embodiment, used as test models in a wake-up test. In the drawings, a side sound source (SS) and a front sound source (FS) are arranged around an acoustic sensor.

FIG. 19A illustrates an acoustic sensor according to the related art. In the acoustic sensor of FIG. 19A, two non-directional microphones 11 and 12 are arranged apart from each other and directivity is implemented by using a time difference of signals arriving at the non-directional microphones 11 and 12. In the test, an interval between the non-directional microphones 11 and 12 was about 5.6 cm, and the SS and the FS were respectively arranged about 1 m away from the center point between the non-directional microphones 11 and 12. FIGS. 19B and 19C illustrate the directional acoustic sensors according to embodiments. The directional acoustic sensor of FIG. 19B is the same as the directional acoustic sensor 600 of FIG. 14 and includes first and second sensing devices 21 and 22 provided on the same plane. In the test, the interval between the first and second sensing devices 21 and 22 was about 5.6 cm, and the SS and the FS were respectively arranged about 1 m away from the center point between the first and second sensing devices 21 and 22. The directional acoustic sensor of FIG. 19C is the same as the directional acoustic sensor 200 of FIG. 4 and includes first and second sensing devices 31 and 32 that are stacked in a vertical direction. In the test, the interval between the first and second sensing devices 31 and 32 was about 3 mm, and the SS and the FS were respectively arranged about 1 m away from the center point between the first and second sensing devices 31 and 32.

Figure 20:
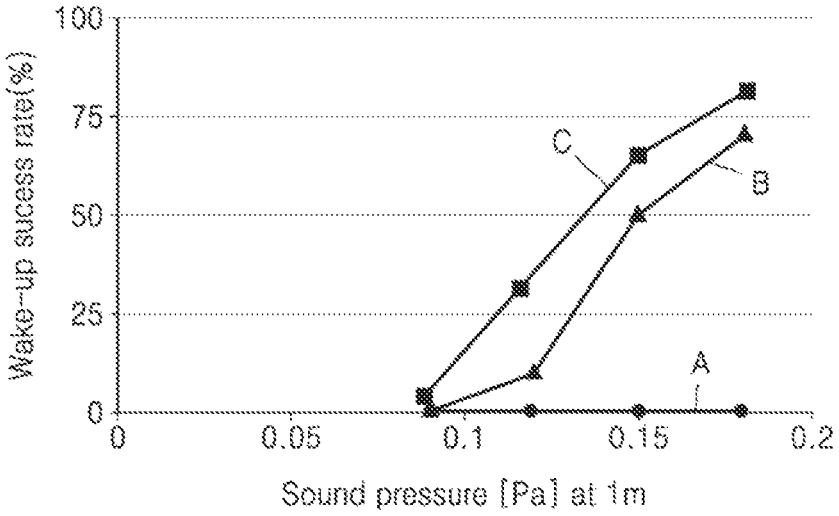
FIG. 20 is a graph showing a comparison of wake-up success rates of the acoustic sensors of FIGS. 19A to 190.

FIG. 20 is a graph showing a comparison of wake-up success rates of the acoustic sensors of FIGS. 19A to 19C. FIG. 20 illustrates a result of the wake-up test using trigger words for voice recognition from the FS while the SS generates noise. In FIG. 20, "A" denotes the acoustic sensor of FIG. 19A, "B" denotes the acoustic sensor of FIG. 19B, and "C" denotes the acoustic sensor of FIG. 19C.

Referring to FIG. 20, it may be seen that the acoustic sensors of FIGS. 19B and 19C according to embodiments have higher wake-up success rates than the acoustic sensor of FIG. 19A according to the related art.

A sensitivity ratio, in detail, a sensitivity ratio of a voice signal in a side direction to a voice signal in a front direction, was measured by using the acoustic sensors of FIGS. 19A to 19C in order to evaluate a degree of influence of noise when a voice signal in the front direction is obtained while noise in the side direction is generated. As a result of the measurement in a frequency range of about 100 Hz to about 8 kHz, the acoustic sensor of 19A according to the related art has a relatively low sensitivity ratio of about 6 dB, whereas the acoustic sensors of FIGS. 19B and 19C according to an embodiment have a relatively high sensitivity ratio of about 20 dB.

Figure 21:
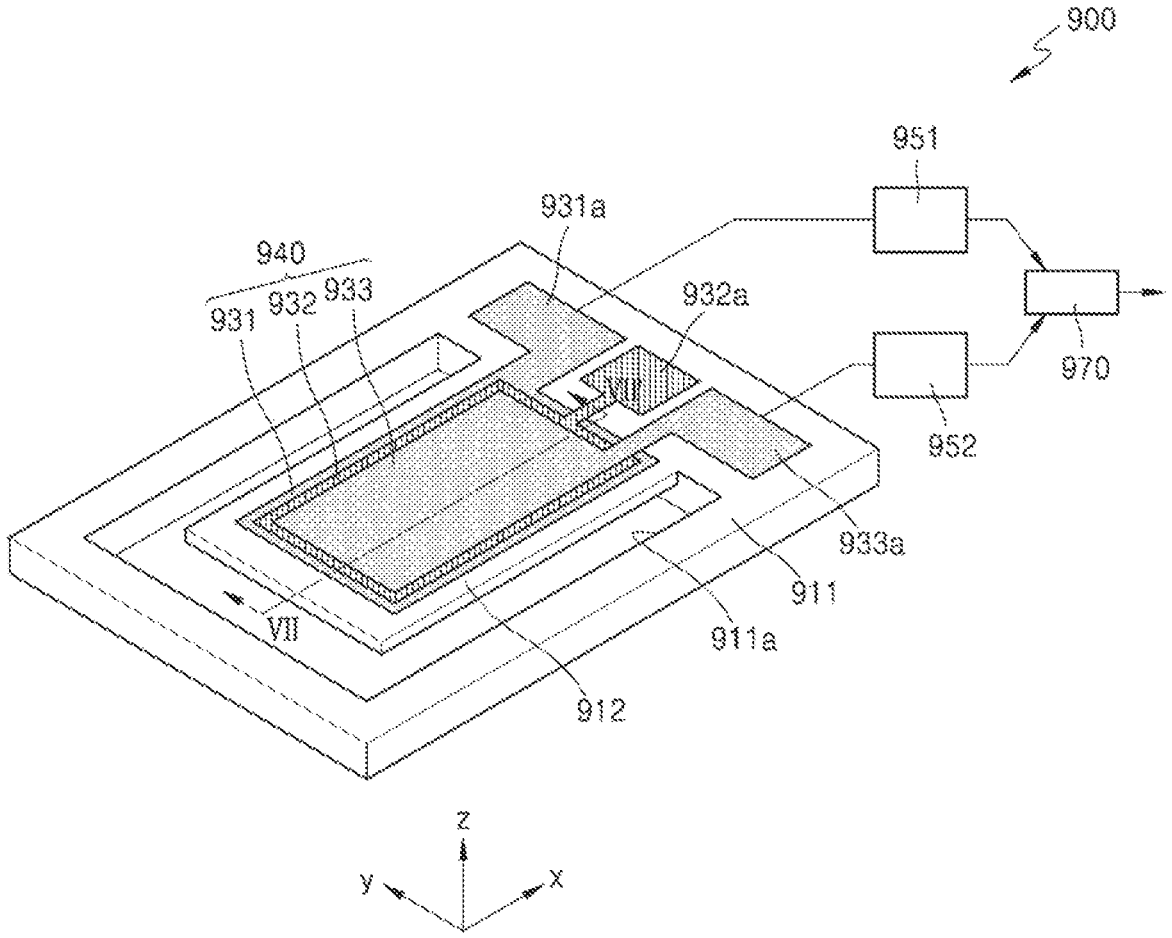
FIG. 21 is a perspective view of a directional acoustic sensor according to another embodiment.
Figure 22:
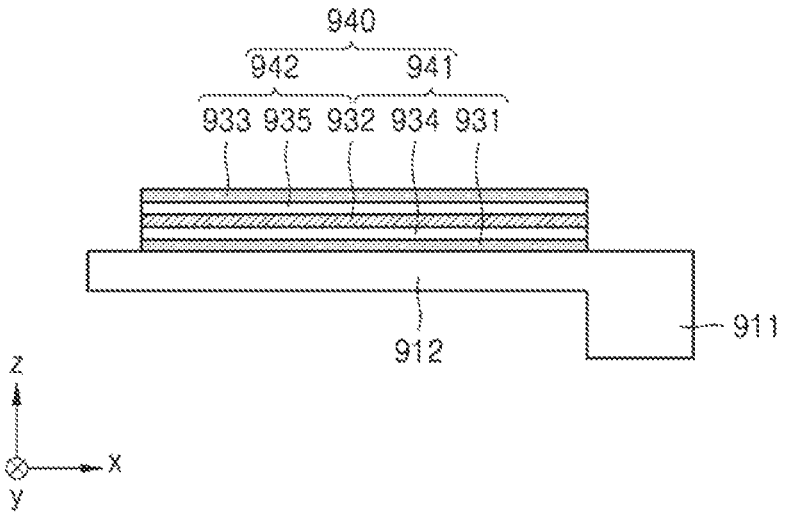
FIG. 22 is a cross-sectional view of the directional acoustic sensor taken along line VII-VII' of FIG. 21.

FIG. 21 is a perspective view of a directional acoustic sensor 900 according to another embodiment. FIG. 22 is a cross-sectional view of the directional acoustic sensor 900, taken along line VII-VII' of FIG. 21.

Referring to FIGS. 21 and 22, the directional acoustic sensor 900 may include a substrate 911 and a resonator 940 provided on the substrate 911. A cavity 911*a* is formed in the substrate 911 by penetrating the same, and a support 912 extends from the substrate 911 toward the cavity 911*a*. The support 912 has one end portion fixed to the substrate 911 and the other end portion that is movable in the vertical direction, for example, the z-axis direction. The substrate 911 may include, for example, a silicon substrate, but the present disclosure is not limited thereto and substrates including various other materials may be used therefor.

The resonator 940 is provided on one surface of the support 912. In detail, the resonator 940 may include a first electrode 931 provided on the upper surface of the support 912, a first piezoelectric layer 934 provided on the first electrode 931, a second electrode 932 provided on the first piezoelectric layer 934, a second piezoelectric layer 935 provided on the second electrode 932, and a third electrode 933 provided on the second piezoelectric layer 935.

The second electrode 932 may be a common electrode. The third electrode 933 may have the same polarity as the first electrode 931. For example, the first, second, and third electrodes 931, 932, and 933 may be a (+) electrode, a (−) electrode, and a (+) electrode, respectively. However, this is merely exemplary, and the first, second, and third electrodes 931, 932, and 933 may be a (−) electrode, a (+) electrode, and a (−) electrode, respectively. The first electrode 931, the first piezoelectric layer 934, and the second electrode 932 may constitute a first resonator 941, whereas the second electrode 932, the second piezoelectric layer 935, and the third electrode 933 may constitute a second resonator 942. The first and second resonators 941 and 942 may share the second electrode 932 as a common electrode.

First, second, and third terminals 931*a*, 932*a*, and 933*a* respectively electrically connected to the first, second, and third electrodes 931, 932, and 933 may be provided on the upper surface of the substrate 911. In FIG. 21, the first terminal 931*a*, the second terminal 932*a*, and the third terminal 933*a* are respectively located at the left, middle, and right sides on the upper surface of the substrate 911 based on the direction facing the +x axis.

When external energy such as sound or pressure is input to the resonator 940, electric energy may be generated. In detail, when sound is input to the resonator 940, the first piezoelectric layer 934 of the first resonator 941 is deformed and thus electric energy may be generated between the first and second electrodes 931 and 932. The electric energy may be output as a first output signal through a first readout circuit 951 connected to the first terminal 931*a*. Also, the second piezoelectric layer 935 of the second resonator 942 is deformed and thus electric energy may be generated between the second and third electrodes 932 and 933. The electric energy may be output as a second output signal through a second readout circuit 952 connected to the third terminal 933*a*.

As the first electrode 931 of the first resonator 941 and the third electrode 933 of the second resonator 942 are configured to have the same polarity, and the second electrode 932 is configured to be a common electrode having a different polarity from the first and second electrodes 931 and 932, the first and second resonators 941 and 942 may generate output signals of different polarities. In detail, the first and second resonators 941 and 942 may generate first and second output signals having reverse phases of different polarities.

A signal processor 970 may generate a final output signal by processing a first output signal generated by the first resonator 941 and a second output signal generated by the second resonator 942. In detail, the signal processor 970 may generate a final output signal by calculating a difference of the first output signal and the second output signal of different polarities. Accordingly, the SNR may be improved.

Figure 23:
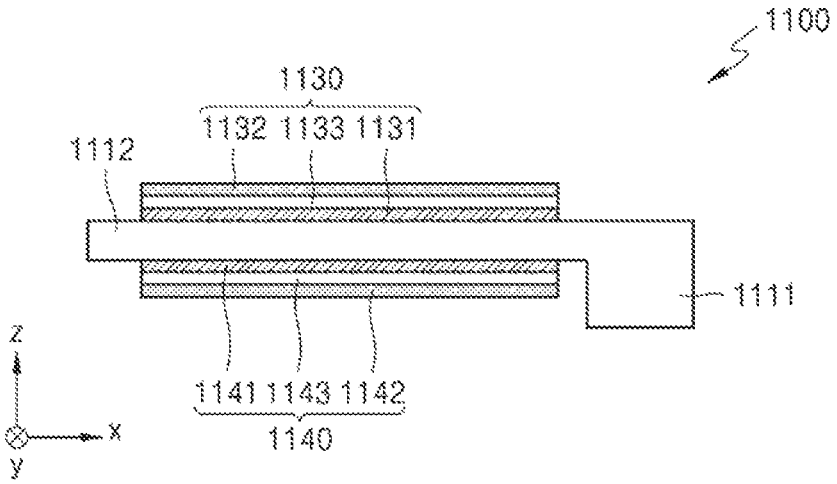
FIG. 23 is a cross-sectional view of a directional acoustic sensor according to another embodiment.

FIG. 23 is a cross-sectional view of a directional acoustic sensor 1100 according to another embodiment. In the directional acoustic sensor 1100 of FIG. 23, unlike the directional acoustic sensor 900 of FIG. 22, a first resonator 1130 is provided on an upper surface of a substrate 1111, and a second resonator 1140 is provided on a lower surface of the substrate 1111.

Referring to FIG. 23, the first resonator 1130 may include a first electrode 1131 provided on an upper surface of a support 1112 of the substrate 1111, a first piezoelectric layer 1133 provided on the first electrode 1131, and a second electrode 1132 provided on the first piezoelectric layer 1133. First and second terminals (not shown) electrically connected to the first and second electrodes 1131 and 1132 may be provided on the upper surface of the substrate 1111.

The second resonator 1140 may include a third electrode 1141 provided on a lower surface of the support 1112 of the substrate 1111, a second piezoelectric layer 1143 provided on the third electrode 1141, and a fourth electrode 1142 provided on the second piezoelectric layer 1143. The third electrode 1141 may have the same polarity as the first electrode 1131, and the fourth electrode 1142 may have the same polarity as the second electrode 1132. Third and fourth terminals (not shown) electrically connected to the third and fourth electrodes 1141 and 1142 may be provided on the lower surface of the substrate 1111.

As the first electrode 1131 of the first resonator 1130 and the third electrode 1141 of the second resonator 1140 are configured to have the same polarity, and the second electrode 1132 of the first resonator 1130 and the fourth electrode 1142 of the second resonator 1140 are configured to have the same polarity, the first and second resonators 1130 and 1140 may generate output signals of different polarities. A signal processor (not shown) may generate a final output signal by calculating a difference of the first output signal 261 and the second output signal 262 of different polarities. Accordingly, the SNR may be improved.

Figure 24:
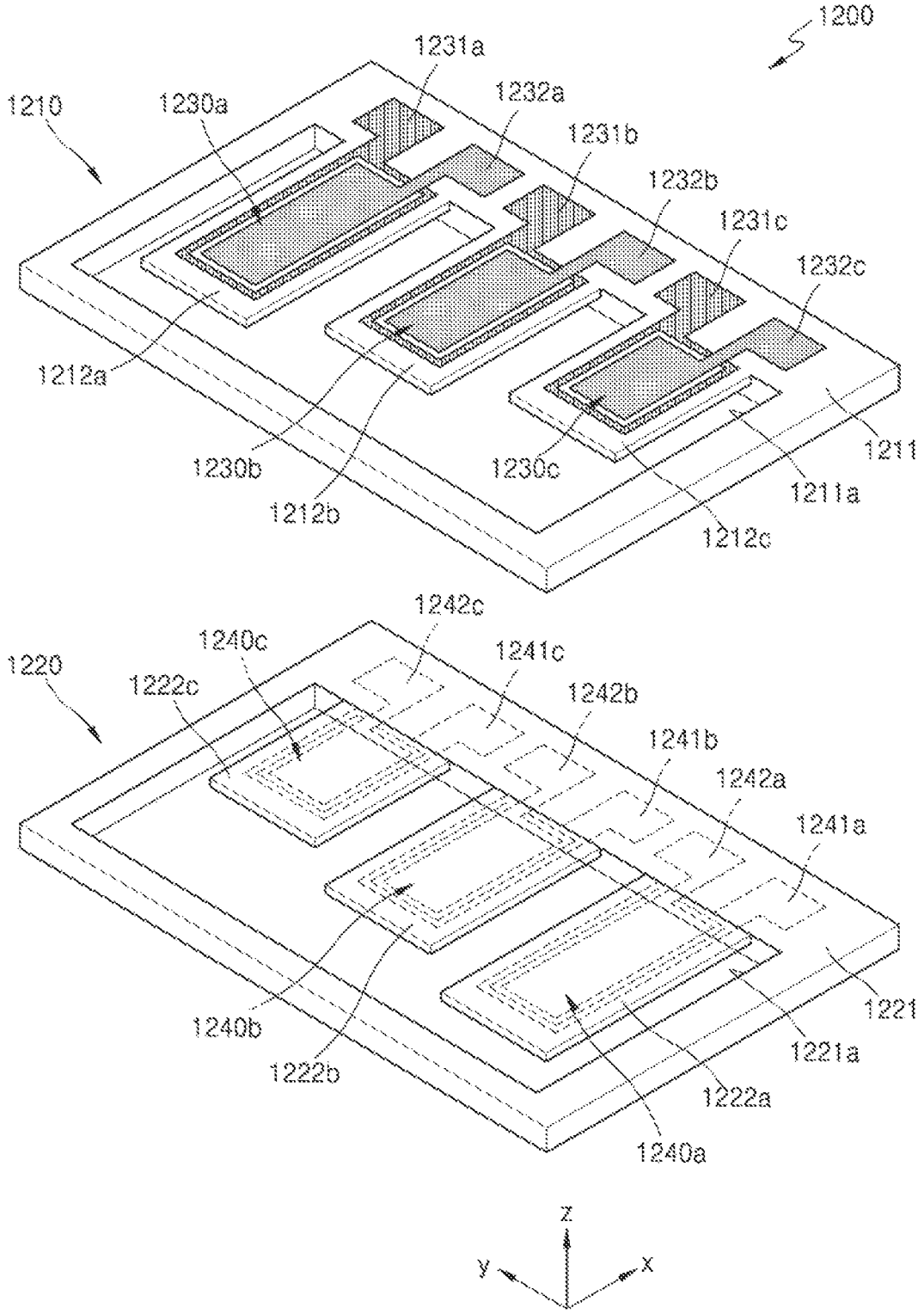
FIG. 24 is an exploded perspective view of a directional acoustic sensor according to another embodiment.
Figure 25:
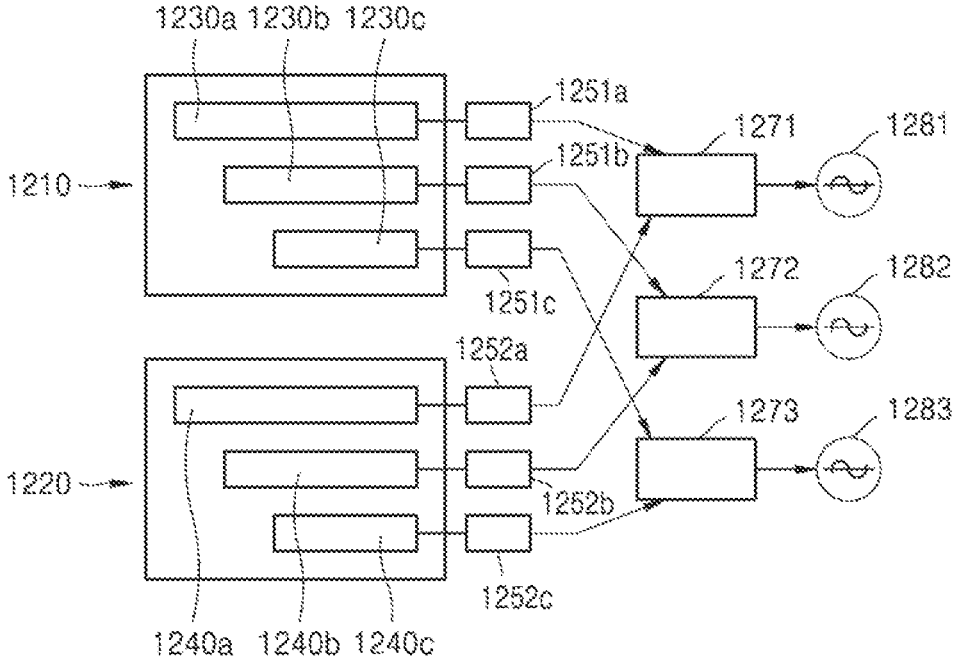
FIG. 25 is a block diagram of a schematic configuration of the directional acoustic sensor of FIG. 24.

FIG. 24 is an exploded perspective view of a directional acoustic sensor 1200 according to another embodiment. FIG. 25 is a block diagram of a schematic configuration of the directional acoustic sensor 1200 of FIG. 24.

Referring to FIGS. 24 and 25, the directional acoustic sensor 1200 may include first and second sensing devices 1210 and 1220 and a plurality of signal processors 1271, 1272, and 1273 for processing signals output from the first and second sensing devices 1210 and 1220. The first and second sensing devices 1210 and 1220 are stacked in one direction, for example, the z-axis direction. The first and second sensing devices 1210 and 1220 may be the same sensing device, and in FIG. 24, the second sensing device 1220 is illustrated to have the same shape as the first sensing device 1210 flipped top to bottom.

The first sensing device 1210 may include a plurality of first resonators 1230*a*, 1230*b*, and 1230*c* provided on a first substrate 1211. A first cavity 1211*a* is formed in the first substrate 1211 by penetrating the same, and a plurality of first supports 1212*a*, 1212*b*, and 1212*c* extend from the first substrate 1211 toward the first cavity 1211*a*.

The first resonators 1230*a*, 1230*b*, and 1230*c* may have different center frequencies from one another. To this end, the first resonators 1230*a*, 1230*b*, and 1230*c* may have different dimensions from one another. For example, the first resonators 1230*a*, 1230*b*, and 1230*c* may have different lengths, different widths, and/or different thicknesses from one another. FIG. 24 illustrates an example case in which the first supports 1212*a*, 1212*b*, and 1212*c* having different lengths are provided on the first substrate 2111 and the first resonators 1230*a*, 1230*b*, and 1230*c* having different lengths are provided on the first supports 1212*a*, 1212*b*, and 1212*c*. FIG. 24 illustrates the three first resonators 1230*a*, 1230*b*, and 1230*c* having first, second, and third center frequencies. However, this is merely exemplary, and the number of the first resonators 1230*a*, 1230*b*, and 1230*c* having different center frequencies may be variously changed.

Each of the first resonators 1230*a*, 1230*b*, and 1230*c* is the same as the first resonator 230 of FIG. 4. In detail, each of the first resonators 1230*a*, 1230*b*, and 1230*c* may include a first electrode (not shown) provided on an upper surface of each of the first supports 1212*a*, 1212*b*, and 1212*c*, a first piezoelectric layer (not shown) provided on the first electrode, and a second electrode (not shown) provided on the first piezoelectric layer. The first and second electrodes may be, for example, a (+) electrode and a (−) electrode, respectively, but the disclosure is not limited thereto.

A plurality of first terminals 1231*a*, 1231*b*, and 1231*c* electrically connected to the first electrodes and a plurality of second terminals 1232*a*, 1232*b*, and 1232*c* electrically connected to the second electrodes may be provided on the upper surface of the first substrate 1211. The first sensing device 1210 may have bi-directivity, for example, in the z-axis direction.

The second sensing device 1220 is provided under the first sensing device 1210. As described above, the second sensing device 1220 may have the same shape as the first sensing device 1210 flipped top to bottom. The second sensing device 1220 may include a plurality of second resonators 1240*a*, 1240*b*, and 1240*c* provided on a second substrate 1221. A second cavity 1221*a* is formed in the second substrate 1221 by penetrating the same, and a plurality of second supports 1222*a*, 1222*b*, and 1222*c* extend from the second substrate 1221 toward the second cavity 1221*a*.

The second resonators 1240*a*, 1240*b*, and 1240*c* may have different center frequencies from one another. In detail, the second resonators 1240*a*, 1240*b*, and 1240*c* may have different center frequencies as the first resonators 1230*a*, 1230*b*, and 1230*c* do. To this end, the second resonators 1240*a*, 1240*b*, and 1240*c* may have different dimensions from one another. FIG. 24 illustrate an example case in which a plurality of second supports 1222*a*, 1222*b*, and 1222*c* having different lengths are provided on the second substrate 1221 and the second resonators 1240*a*, 1240*b*, and 1240*c* having the same lengths as those of the first resonators 1230*a*, 1230*b*, and 1230*c* are provided on the second supports 1222*a*, 1222*b*, and 1222*c*. FIG. 24 illustrates the three second resonators 1240*a*, 1240*b*, and 1240*c* having first, second, and third center frequencies. However, this is merely exemplary, and the number of the second resonators 1240*a*, 1240*b*, and 1240*c* having different center frequencies may be variously changed in response to the first resonators 1230*a*, 1230*b*, and 1230*c*.

Each of the second resonators 1240*a*, 1240*b*, and 1240*c* may be the same as the second resonator 240 of FIG. 4. In detail, each of the second resonators 1240*a*, 1240*b*, and 1240*c* may include a third electrode (not shown) provided on a lower surface of each of the second supports 1222*a*, 1222*b*, and 1222*c*, a second piezoelectric layer (not shown) provided on the third electrode, and a fourth electrode (not shown) provided on the second piezoelectric layer. The third electrode may have the same polarity as the first electrode, and the fourth electrode may have the same polarity as the second electrode. For example, when the first and second electrodes are a (+) electrode and a (−) electrode, respectively, the third and fourth electrode may be a (+) electrode and a (−) electrode, respectively.

A plurality of third terminals 1241*a*, 1241*b*, and 1241*c* electrically connected to a plurality of third electrodes and a plurality of fourth terminals 1242*a*, 1242*b*, and 1242*c* electrically connected to a fourth electrode may be provided on a lower surface of the second substrate 1221. The second sensing device 1220 may have the same directivity as the first sensing device 1210.

The first and second sensing devices 1210 and 1220 may be arranged to operate in synchronism with an input of external energy. The first and second sensing devices 1210 and 1220 may be arranged to have an interval of, for example, substantially 10 cm or less, in the z-axis direction. For example, first and second sensing devices 1210 and 1220 may be arranged to have an interval of substantially 0 mm to about 3 mm. However, this is merely exemplary, and the interval between the first and second sensing devices 1210 and 1220 may be variously changed. As such, when the first and second sensing devices 1210 and 1220 are arranged close to each other, the directional acoustic sensor 1200 may be implemented to be compact.

Pairs of the first and second resonators 1230*a* and 1240*a*, 1230*b* and 1240*b*, and 1230*c* and 1240*c* having the same center frequency may constitute one unit sensor. For example, a pair of the first and second resonators 1230*a* and 1240*a* having a first center frequency may constitute a first unit sensor, a pair of the first and second resonators 1230*b* and 1240*b* having a second center frequency may constitute a second unit sensor, and a pair of the first and second resonators 1230*c* and 1240*c* having a third center frequency may constitute a third unit sensor.

When sound is input to the first resonators 1230*a*, 1230*b*, and 1230*c*, the first piezoelectric layer is deformed and thus electric energy may be generated between the first and second electrodes. The electric energy may be output as a plurality of first output signals having different center frequencies through first readout circuits 1251*a*, 1251*b*, and 1251*c*. When sound is input to the second resonators 1240*a*, 1240*b*, and 1240*c*, the second piezoelectric layer is deformed and thus electric energy may be generated between the third and fourth electrodes. The electric energy may be output as a plurality of second output signals having different center frequencies through second readout circuits 1252*a*, 1252*b*, and 1252*c*.

In the present embodiment, as the first electrode of each of the first resonators 1230*a*, 1230*b*, and 1230*c* and the third electrode of each of the second resonators 1240*a*, 1240*b*, and 1240*c* are configured to have the same polarity, and the second electrode of each of the first resonators 1230*a*, 1230*b*, and 1230*c* and the fourth electrode of each of the second resonators 1240*a*, 1240*b*, and 1240*c* are configured to have the same polarity, the output signals of different polarities may be generated.

For example, in the first unit sensor, a pair of the first and second resonators 1230*a* and 1240*a* may have a first center frequency and generate first and second output signals having reverse phases of different polarities. In the second unit sensor, a pair of the first and second resonators 1230*b* and 1240*b* may have a second center frequency and generate first and second output signals having reverse phases of different polarities. In the third unit sensor, a pair of the first and second resonators 1230*c* and 1240*c* may have a third center frequency and generate first and second output signals having reverse phases of different polarities.

The signal processors 1271, 1272, and 1273 may be provided corresponding to a plurality of unit sensors. For example, the signal processors 1271, 1272, and 1273 may include first, second, and third signal processors 1271, 1272, and 1273 corresponding to the first, second, and third unit sensors.

The first signal processor 1271 may generate a first final output signal 1281 based on the first and second output signals. For example, the first signal processor 1271 may generate a first final output signal 1281 by calculating a difference of first and second output signals of different polarities output from the first and second resonators 1230*a* and 1240*a* of the first unit sensor. In other words, the first signal processor 1271 may subtract the first output signal from the second output signal. As another example, the first signal processor 1271 may alter a sign of one of the first output signal and the second output signal, and then add the first output signal and the second output signal.

The second signal processor 1272 may generate a second final output signal 1282 based on the first and second output signals. For example, the second signal processor 1272 may generate a second final output signal 1282 by calculating a difference of the first and second output signals of different polarities output from the first and second resonators 1230*b* and 1240*b* of the second unit sensor. In other words, the second signal processor 1272 may subtract the first output signal from the second output signal. As another example, the second signal processor 1272 may alter a sign of one of the first output signal and the second output signal, and then add the first output signal and the second output signal.

The third signal processor 1273 may generate a third final output signal 1283 based on the first and second output signals. For example, the third signal processor 1273 may generate a third final output signal 1283 by calculating a difference of the first and second output signals of different polarities output from the first and second resonators 1230*c* and 1240*c* of the third unit sensor. In other words, the third signal processor 1273 may subtract the first output signal from the second output signal. As another example, the third signal processor 1273 may alter a sign of one of the first output signal and the second output signal, and then add the first output signal and the second output signal.

Accordingly, the first, second, and third final output signals 1281, 1282, and 1283 having improved SNR may be obtained. For instance, because the signs of the output signals generated by the units sensors are opposite to each other, when the difference between the first output signal and the second output signal is calculated, the external signal received by the unit sensors is doubled, and a random noise or a typical noise from a circuit, which is not an external signal, is reduced. In this way, the unit sensors are combined to generate output signals of opposite polarities with regard to the same input signal, and the difference of the output signals is calculated to double the amplitude of the externally received input signals, and to reduce a random noise or a noise from a circuit.

Figure 26:
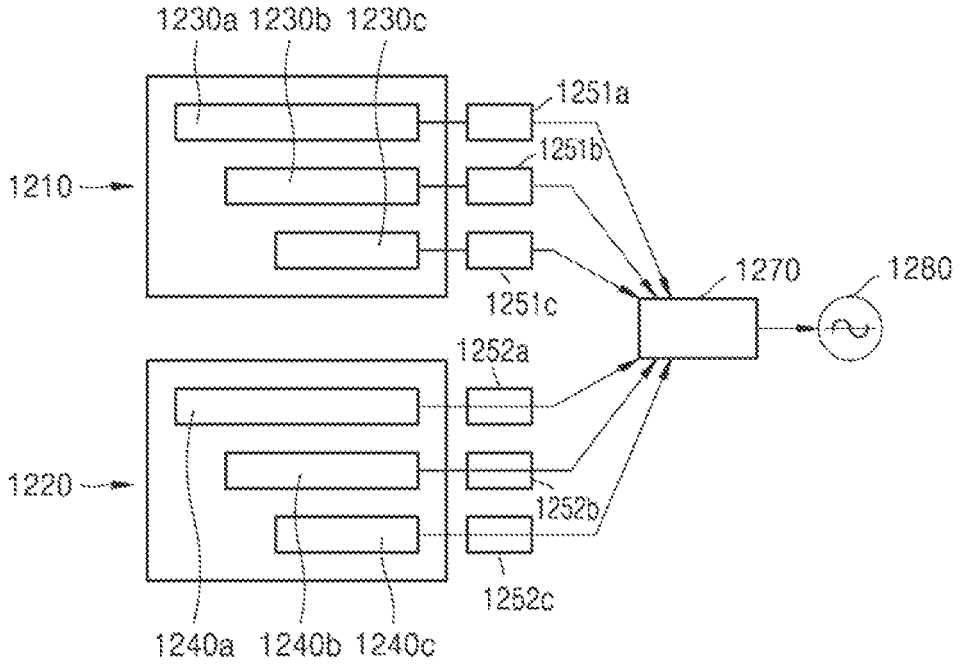
FIG. 26 is a block diagram of a modification of the directional acoustic sensor of FIG. 25.

FIG. 26 is a block diagram of a modification of the directional acoustic sensor of FIG. 25.

Referring to FIG. 26, the first sensing device 1210 may generate one first output signal of the same polarity by integrating the signals output from the first resonators 1230*a*, 1230*b*, and 1230*c* respectively via the first readout circuits 1251*a*, 1251*b*, and 1251*c*. Furthermore, the second sensing device 1220 may generate one second output signal of a polarity different from that of the first output signal by integrating the signals output from the second resonators 1240*a*, 1240*b*, and 1240*c* respectively via second readout circuits 1252*a*, 1252*b*, and 1252*c*. A signal processor 1270 may generate a final output signal 1280 by calculating a difference of the first and second output signals of different polarities output from the first and second sensing devices 1210 and 1220.

Figure 27:
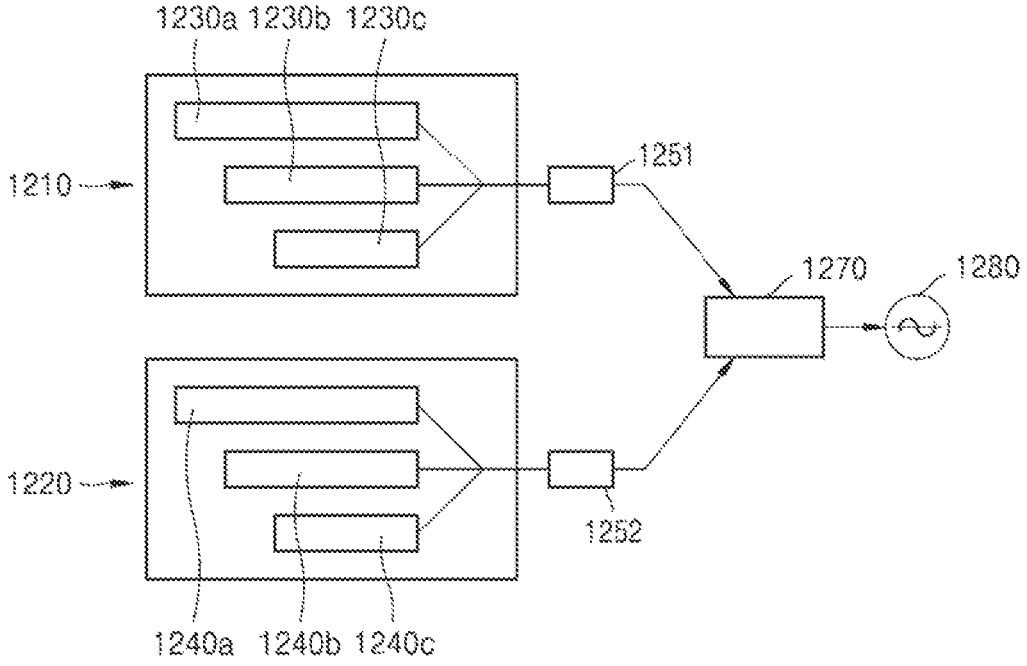
FIG. 27 is a block diagram of another modification of the directional acoustic sensor of FIG. 25.

FIG. 27 is a block diagram of another modification of the directional acoustic sensor of FIG. 25

Referring to FIG. 27, the first sensing device 1210 may integrate outputs from the first resonators 1230*a*, 1230*b*, and 1230*c* into one output through wiring and then generate the first output signal of the same polarity through a first readout circuit 1251. Furthermore, the second sensing device 1220 may integrate outputs from the second resonators 1240*a*, 1240*b*, and 1240*c* into one output through wiring and then generate a second output signal of a polarity different from that of the first output signal through a second readout circuit 1252.

The signal processor 1270 may generate the final output signal 1280 based on the first output signal generated by the first sensing device 1210 and the second output signal generated by the second sensing device 1220. For example, the signal processor 1270 may generate the final output signal 1280 by calculating a difference of the first and second output signals of different polarities output from the first and second sensing devices 1210 and 1220. In other words, the signal processor 1270 may subtract the first output signal from the second output signal. As another example, the signal processor 1270 may alter a sign of one of the first output signal and the second output signal, and then add the first output signal and the second output signal.

In the above description, presented is an example case in which each unit sensor has the same structure as the first and second sensing devices 210 and 220 of FIG. 4. However, the disclosure is not limited thereto, and each unit sensor may have the same structure as the first and second sensing devices 310 and 320, 410 and 420, and 510 and 520 of FIGS. 10, 11, and 13. Furthermore, although FIG. 24 illustrates an example case in which the first and second sensing devices 1210 and 1220 are stacked in one direction such as, for example, the z-axis direction, the first and second sensing devices 1210 and 1220 may be provided on the same plane, for example, the x-y plane, as illustrated in FIGS. 14, 16, and 18.

Figure 28:
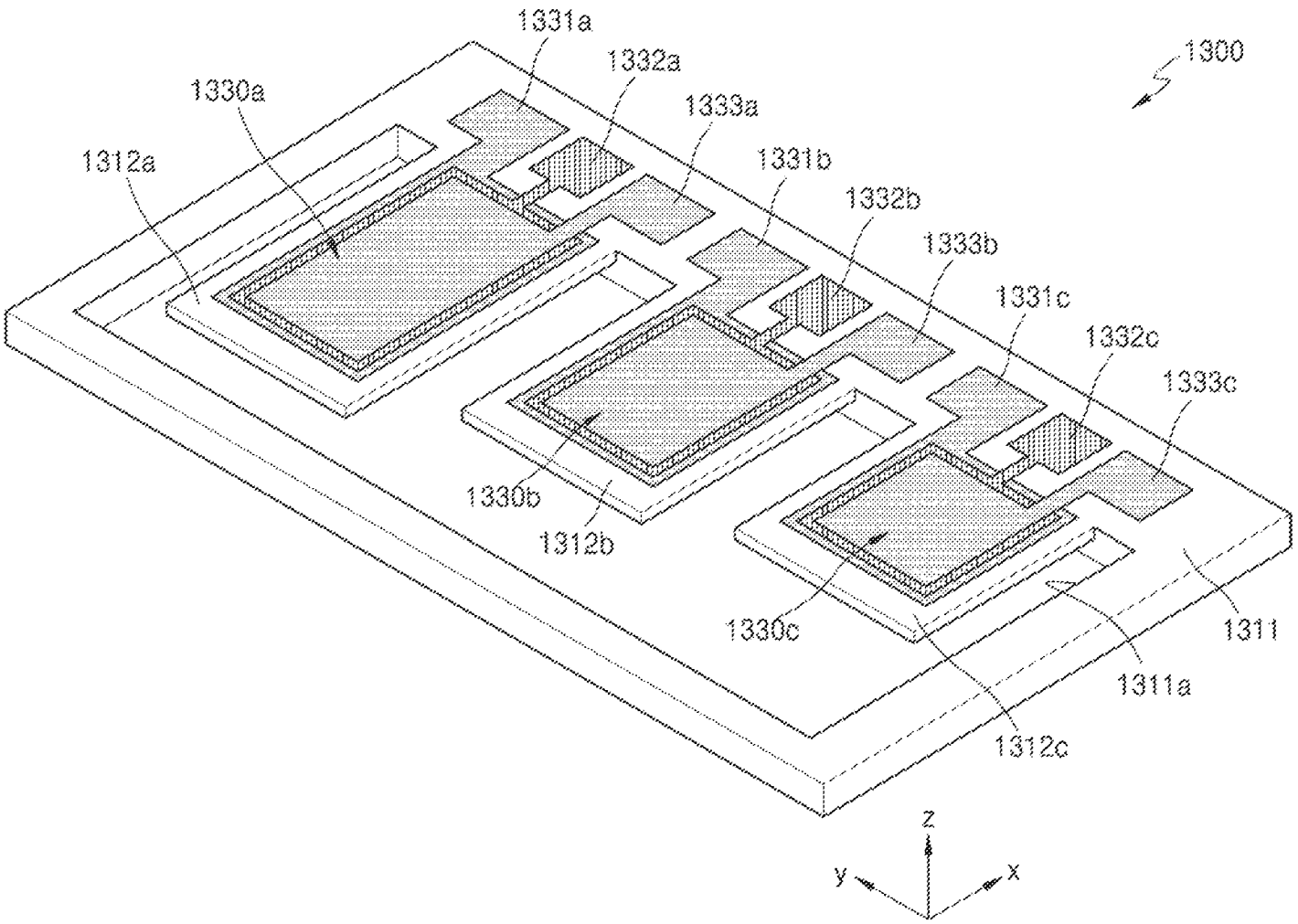
FIG. 28 is a perspective view of a directional acoustic sensor according to another embodiment.

FIG. 28 is a perspective view of a directional acoustic sensor 1300 according to another embodiment.

Referring to FIG. 28, the directional acoustic sensor 1300 may include a substrate 1311, a plurality of resonators 1330*a*, 1330*b*, and 1330*c* provided on the substrate 1311, and a plurality of signal processors (not shown). A cavity 1311*a* is formed in the substrate 1311 by penetrating through the same, and a plurality of supports 1312*a*, 1312*b*, and 1312*c* extend from the substrate 1311 toward the cavity 1311*a*.

The resonators 1330*a*, 1330*b*, and 1330*c* may have different center frequencies from one another. To this end, the resonators 1330*a*, 1330*b*, and 1330*c* may have different dimensions from one another. For example, the resonators 1330*a*, 1330*b*, and 1330*c* may have different lengths, different widths, and/or different thicknesses. FIG. 28 illustrates an example case in which the supports 1312*a*, 1312*b*, and 1312*c* having different lengths are provided on the substrate 1311 and the resonators 1330*a*, 1330*b*, and 1330*c* having different lengths are provided on the supports 1312*a*,

1312*b*, and 1312*c*. FIG. 28 illustrates the three resonators 1330*a*, 1330*b*, and 1330*c* having first, second, and third center frequencies. However, this is merely exemplary, and the number of the resonators 1330*a*, 1330*b*, and 1330*c* having different center frequencies may be variously changed.

Each of the resonators 1330*a*, 1330*b*, and 1330*c* is the same as the resonator 940 of FIG. 21. In detail, each of the resonators 1330*a*, 1330*b*, and 1330*c* may include a first electrode (not shown) provided on an upper surface of each of the supports 1312*a*, 1312*b*, and 1312*c*, a first piezoelectric layer (not shown) provided on the first electrode, a second electrode (not shown) provided on the first piezoelectric layer, a second piezoelectric layer (not shown) provided on the second electrode, and a third electrode (not shown) provided on the second piezoelectric layer.

The second electrode may be a common electrode, and the third electrode may have the same polarity as the first electrode. For example, the first, second, and third electrodes may be a positive (+) electrode, a negative (−) electrode, and a positive (+) electrode, respectively. Accordingly, the first electrode, the first piezoelectric layer, and the second electrode may constitute a first resonator, whereas the second electrode, the second piezoelectric layer, and the third electrode may constitute a second resonator. First terminals 1331*a*, 1331*b*, and 1331*c* electrically connected to the first electrode, second terminals 1332*a*, 1332*b*, and 1332*c* electrically connected to the second electrode, and third terminals 1333A, 1333B, and 1333*c* electrically connected to the third electrode may be provided on an upper surface of the substrate 1311.

A pair of the first and second resonators having the same center frequency may constitute one unit sensor. For example, a resonator 1330*a* including a pair of first and second resonators having a first center frequency may constitute a first unit sensor, a resonator 1330*b* including a pair of the first and second resonators having a second center frequency may constitute a second unit sensor, and a resonator 1330*c* including a pair of the first and second resonators having a third center frequency may constitute a third unit sensor.

In the present embodiment, similar to the illustration of FIG. 25, a plurality of signal processors (not shown) may be provided corresponding to a plurality of unit sensors. For example, a plurality of signal processors may include first, second, and third signal processors corresponding to the first, second, and third unit sensors.

In the present embodiment, similar to the illustration of FIG. 26, one signal processor (not shown) may be provided. Furthermore, in the present embodiment, similar to the illustration of FIG. 27, one signal processor (not shown) may be provided.

According to the above-described embodiments, as the sensing devices generate output signals of different polarities, and the final output signal is generated based on the output signals (e.g., a difference between the generated output signals of different polarities is calculated), the SNR may be improved while directivity is maintained. Furthermore, as the sensing devices are arranged close to each other, a directional acoustic sensor may be implemented to be compact.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims.

What is claimed is:

1. A directional acoustic sensor comprising:

a first sensing device configured to generate different output gains based on different input directions of external energy, and configured to generate at least one first output signal having a first polarity based on external energy received from an input direction;

a second sensing device configured to generate different output gains based on different input directions of external energy, and configured to generate at least one second output signal having a second polarity, that is different than the first polarity, based on the external energy received from the input direction; and at least one signal processor configured to generate at least one final output signal based on the at least one first output signal and the at least one second output signal, wherein the first sensing device comprises at least one first resonator, wherein the second sensing device comprises at least one second resonator, and wherein the first sensing device and the second sensing device are provided on the same plane.

2. The directional acoustic sensor of claim 1, wherein the first sensing device has the same directivity as the second sensing device.

3. The directional acoustic sensor of claim 1, wherein the first sensing device comprises a first substrate on which the at least one first resonator is provided and the second sensing device comprises a second substrate on which the at least one second resonator is provided.

4. The directional acoustic sensor of claim 3, wherein at least one first support on which the at least one first resonator is provided extends from the first substrate, and wherein at least one second support on which the at least one second resonator is provided extends from the second substrate.

5. The directional acoustic sensor of claim 4, wherein the first substrate and the second substrate are provided integrally with each other or apart from each other.

6. The directional acoustic sensor of claim 4, wherein the first resonator comprises a first electrode provided on a surface of the first support, a first piezoelectric layer provided on the first electrode, and a second electrode provided on the first piezoelectric layer, and wherein the second resonator comprises a third electrode provided on a surface of the second support and having the same polarity as the second electrode, a second piezoelectric layer provided on the third electrode, and a fourth electrode provided on the second piezoelectric layer and having the same polarity as the first electrode.

7. The directional acoustic sensor of claim 1, wherein the first sensing device comprises a plurality of first resonators configured to respectively generate a plurality of first output signals having different center frequencies, and wherein the second sensing device comprises a plurality of second resonators configured to respectively generate a plurality of second output signals having different center frequencies corresponding to the plurality of first resonators.

8. The directional acoustic sensor of claim 7, wherein a pair of a first resonator and a second resonator having the same center frequency and corresponding to each other are configured to respectively generate the first output signals and the second output signals of different polarities with respect to the external energy received from the input direction.

9. The directional acoustic sensor of claim 8, wherein the at least one signal processor comprises a plurality of signal processors configured to respectively generate a plurality of final output signals based on the plurality of first output signals and the plurality of second output signals.

10. The directional acoustic sensor of claim 8, wherein the at least one signal processor comprises a single signal processor configured to generate a single final output signal based on the plurality of first output signals and the plurality of second output signals.

* * * * *